US009514619B1

(12) United States Patent
Nesemeier et al.

(10) Patent No.: US 9,514,619 B1
(45) **Date of Patent: *Dec. 6, 2016**

(54) APPARATUS, SYSTEMS, AND METHODS FOR SIGNAL LOCALIZATION AND DIFFERENTIATION

(71) Applicants: Frederick G. Nesemeier, Reno, NV (US); Gary F. Nesemeier, Reno, NV (US); David C. Williams, Carson City, NV (US)

(72) Inventors: Frederick G. Nesemeier, Reno, NV (US); Gary F. Nesemeier, Reno, NV (US); David C. Williams, Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/055,534

(22) Filed: Feb. 27, 2016

Related U.S. Application Data

(63) Continuation of application No. 14/846,776, filed on Sep. 6, 2015, now Pat. No. 9,305,442.

(51) Int. Cl.
*G08B 6/00* (2006.01)
*G08B 3/06* (2006.01)

(52) U.S. Cl.
CPC ..... *G08B 3/06* (2013.01)

(58) Field of Classification Search
CPC ..... A63B 2071/0655; A63B 2071/0663; A63B 2071/0622; A63B 2071/0625; A63B 2225/50; G08B 6/00; G08B 7/06; G08B 27/00; G06F 3/01; G06F 3/016
USPC ..... 340/326, 321, 323 R, 407.1, 539.11, 340/573.1; 345/156, 173; 380/239, 251, 380/255, 270; 455/90.1, 575.2; 116/200
See application file for complete search history.

(56) References Cited

U.S. PATENT DOCUMENTS

| | | | | |
|---|---|---|---|---|
| 7,173,533 | B1 * | 2/2007 | Beron | G08B 1/08 340/4.12 |
| 2003/0058744 | A1 | 3/2003 | Calace | |
| 2005/0239545 | A1 | 10/2005 | Rowe | |
| 2007/0115890 | A1 * | 5/2007 | Yi | H04W 72/14 370/331 |
| 2009/0205583 | A1 | 8/2009 | So | |
| 2010/0102938 | A1 * | 4/2010 | Delia | A63B 71/0619 340/326 |
| 2010/0184563 | A1 | 7/2010 | Molyneux et al. | |
| 2013/0120123 | A1 | 5/2013 | Aman et al. | |
| 2015/0022321 | A1 | 1/2015 | Lefevre | |

* cited by examiner

*Primary Examiner* — Hung T Nguyen
(74) *Attorney, Agent, or Firm* — D. C. Williams

(57) ABSTRACT

Apparatus, systems, and methods for providing transmission and localized reception of audio, visual, and tactile signaling are taught for a myriad of useful purposes, including embodiments that permit differentiation between selected groups of intended recipients to permit simultaneous use of multiple instances of this technology in close proximity, if desired.

20 Claims, 8 Drawing Sheets

301
302
303
304
305

301
302
306
307

APPARATUS, SYSTEMS, AND METHODS FOR SIGNAL LOCALIZATION AND DIFFERENTIATION

RELATED APPLICATIONS

This application is a Continuation and claims domestic benefit of Applicants' U.S. Nonprovisional Utility patent application Ser. No. 14/846,776, now U.S. Pat. No. 9,305,442, entitled "Apparatus, Systems, and Methods for Signal Localization and Differentiation", filed Sep. 6, 2015. Applicant also incorporates said application herein by reference in its entirety and for all useful purposes. In the event of inconsistency between anything stated in this specification and anything incorporated by reference in this specification, this specification shall govern.

FIELD OF THE INVENTION

The present invention relates to apparatus, systems, and methods for providing transmission and localized reception of audio, visual, and tactile signaling for a myriad of useful purposes, including embodiments that permit differentiation between selected groups of intended recipients to permit simultaneous use of multiple instances of this technology in close proximity, if desired.

BACKGROUND

The practice of signaling between living organisms is believed to be as old as the existence of life itself. Humans constantly perform activities which intentionally generate some form of stimulus capable of reception by at least one of the five human sensory capabilities (sight, sound, touch, smell and taste) to signal or convey information to others. The most common of these involve some form of visual or aural information, with tactile (touch-based) signaling methods less common and the intentional use of smell or taste-based methods used infrequently. Most common signaling or communication activities may be described as "broadcast" methods where reception of visual or aural information is meant for general reception and not exclusively confined to a particular recipient, rather than "person-to-person" method of communication specifically directed toward, and reception-limited to, one or more specific recipients. Whether a verbal communication is overheard by a party for which the communication was not intended, or a visual signal flashed to a passing motorist is also inadvertently observed by a nearby law enforcement officer, broadcast methods of signaling may often result in confusing situations when unintended parties mistake communications directed toward others as having been meant for them.

Such broadcast signaling methods are often desirable, including but limited to screaming "FIRE!" in a crowded theater in the event of an actual fire, and are generally easy to perform. Establishing a reliable and exclusive point-to-point signaling link with one intended recipient may be problematic or even impossible under some circumstances. Establishing a reliable and exclusive point-to-point communication or signaling link from one originator to a multiple of intended recipients is almost always a more difficult undertaking. The ability to differentiate between desired and undesired recipients by either enabling reception by only those desired, disabling reception by those undesired, or some combination of the two is highly dependent upon a number of factors, including but not limited to the number of persons in each group and their identities, their physical proximities to the originator, any limitation(s) or restrictions on their ability to sense the particular stimuli of the signal, the nature of the signal, and the like. The inability of prior art signaling methods to reliably convey the desired information without creating the possibility of confusion or misunderstandings as to who the intended recipient(s) may be is a problem remaining to be solved thousands of years into the human experience.

As one modern non-limiting example of a situation in which confusion is prevalent when conventional aural broadcast signaling is utilized, consider the circumstances in many types of sporting activities. The use of a common signaling whistle by referees or other game administrators is ubiquitous in many sports, including but not limited to football, basketball, soccer, and others. The piercing sound of the whistle is intentionally created for its ability to project for considerable distances and to be heard in the presence of considerable background noise and sports equipment which may impair the hearing of players. Further, it is critical that the sound be unquestionably and immediately detected by all game participants while their attention is focused entirely on the game and they are not specifically devoting great effort to actively listen for whistles. In a professional or semi-professional game situation, only one principal activity is typically occurring at any one time. Although there is usually more than one referee or game administrator, the sound of any whistle signal will be readily interpreted to pertain to that single activity and the players will be easily able to ascertain that the signal was intended for them. However, when there is more than one activity occurring in close proximity as is usually the case during training or practice periods, the sounds of whistles from coaches and trainers supervising separate activities usually bleed from one activity area to adjacent areas due to the inability to effectively limit the range of the sound. See, for example, the arrangement of multiple soccer fields in very close proximity depicted in FIG. 1. To some extent, problems attributable to such arrangements may be overcome by the use of whistles tuned to slightly different tones, but in doing so, a certain amount of subliminal processing by the intended recipients will still be required to ascertain if the signal was intended for them or is an errant signal meant for others and the results will not be wholly satisfactory.

It is expected that highly skilled and practiced players would be able to adapt to these limitations, particularly since their activities are usually conducted in areas with adequate space between potentially conflicting signaling regions. However, in other facets of sports, and particularly in youth sports activities where the participants are neither highly skilled nor practiced, it is very common for a number of games or practice sessions to be conducted in close proximity to each other. For example, a typical football field found at most high schools is approximately 360 feet long by 160 feet wide. Fields for youth soccer may vary in size from as small as 60 feet by 90 feet, leading to the possibility that a large number of youth soccer fields may be overlaid onto the area occupied by a single high school football field. One example of how youth soccer fields may be established in close proximity to each other is provided as FIG. 1. With simultaneous games or practice occurring on adjacent fields, it is highly confusing at best, and impossible at the worst, for young players to be able to distinguish the sound of the whistle of their referee(s) from those of the referee(s) on adjacent fields. The referees' potential inability to effectively control the games and the participants' inability to play the game enjoyably represents a considerable obstacle to the proper conduct of these games. Further, any errant whistle sounds from unauthorized sources with malicious intent only further degrade the game or training experience for the participants, coaches, and spectators.

What is needed is a solution to the problem of providing broadcast-type signals from authorized game or training personnel that are received only by authorized participants of the game or other activity under their purview and not by any unintended recipients, thereby differentiating between the two. Further, such solution must be capable of operating in an environment where multiple instances are simultaneously deployed without adverse interaction. Preferably, this solution will also permit a single signal broadcast by the originator to provide multiple stimuli to the intended recipients to enhance their ability to receive the signals using one or more of their aural, visual, and tactile senses. This feature would effectively overcome any physical disabilities or other limitations of some participants, providing an equivalent experience for all. Further, the physical implementation of specific embodiments should comprise a form familiar to the users so that no additional skills or period of adaptation is required to transition from prior art systems to those taught herein.

As another modern non-limiting example of a situation in which confusion is prevalent consider the circumstances in training or guiding animals for show or for distinct activities like shows, guide animal training, obedience, or hunting. The use of a common signaling whistle limits the number of activities due to the limitations of an aural broadcast with a limited set of commands by one trainer or handler. The piercing sound of the whistle is intentionally created for its ability to project for considerable distances and to be heard in the presence of considerable background noise as well as other sensory input. Further, it is critical that the sound be unquestionably and immediately detected by all participants while their attention is focused entirely on the activity at hand to overcome any distraction due to other animals, or different visual, aural, and olfactory sensations. They are not specifically devoting great effort to actively listen for whistles. In a situation where a single, highly trained animal is involved, only one principal activity is typically occurring at any one time and the set of activities may be limited. The sound of any whistle signal will be readily interpreted to pertain to that single activity from a small group and the participant will be easily able to ascertain that the signal was intended for them. (Often a pattern can be used also like 2 or 3 tweets from a small set of commands so that 4 sport commands are available) However, when there is more than one activity occurring in close proximity with multiple handlers and trainers supervising separate activities, they usually bleed from one activity area to adjacent areas due to the inability to effectively limit the range of the sound. To some extent, this may be overcome by the use of whistles tuned to slightly different tones, but in doing so, a certain amount of subliminal processing the intended recipients will still be required to ascertain if the signal was intended for them or is an errant signal meant for others. In the case of animals, they have limited ability to cognitively differentiate where the signal is coming from and if it is meant for them. This often means that the communication with those animals is tightly limited by the required space to clearly differentiate where the signal originates.

It is expected that in competitions or in live events where a highly trained and/or experienced animal is participating that it would be able to adapt to these limitations, particularly since their activities are usually conducted in areas with adequate space between potentially conflicting signaling regions and their set of possible commands are limited. However, in other facets of animal events, and particularly in animal training activities where the participants are neither highly skilled nor practiced, it could be common for a number of training sessions to be conducted in close proximity to each other. For example, a typical training field may be approximately 80 feet long by 120 feet wide. Different types of training fields may vary in size from as small as 30 feet by 30 feet, leading to the possibility that a large number of training activities may be overlaid onto the area occupied by a single training field or public park. Other activities may be conducted within the same general area by participants not confined to any set boundaries as is common in team sports. For example, numerous animal trainers and their animals may be interspersed within a single confined area. In these situations, signaling confusion between the various handlers and their animals may render the area unusable for any significant training purposes.

Another situation in which confusion of audio signals may exist is on factory floors. Present communication methods between small groups of employees include phones, walkie-talkies, or general public address (PA) system broadcasts via speakers to a wide area. Many complex systems of automation today that run the same products consistently have minimal human interaction for monitoring and communication and instead have sensors and automatic process change devices to handle any process contingency in a very efficient manner. However, when a new process is being set up or a line has a lot of variability, full automation is not always possible. In those cases the workers need to be able to communicate clearly and quickly in order to keep the line moving efficiently while maintaining appropriate safety processes.

It is expected that an existing highly optimized production line that has been well-established has minimal need for any worker input or discussion. However, in new lines or lines with a lot of variability, there will be a need for more human communication and concise interaction to maintain the process flow and to adapt to unforeseen events for which a paper plan did not account. For example in gaming when setting up a temporary line for a new product in a pilot run. There will be time studies and some preliminary automation in the form of rollers, belts, emergency stops, and possibly some optics but mostly, workers will be controlling the product flow manually with walkie-talkies and hand signals or gestures. There will be situations for safety issues, calls for assistance, or on the fly enhancements to the process. These lines are often in close proximity to other pilot lines or near an actual established production line and the current process is usually that people manually stop lines and then there is a discussion about why the line stopped, what is going on, or other extraneous conversation just getting to the intent of the vague communication.

What is needed is a solution to the problem of providing broadcast-type signals from an authorized source to communicate with intended recipients while simultaneously preventing any accidental reception by, and subsequent confusion for, any unintended recipients. Apparatuses and systems capable of differentiating between intended and unintended recipients would be a novel and useful solution to the existing problems. Further, such solution must be capable of operating in an environment where multiple instances are simultaneously deployed without adverse interaction. Preferably, this solution will also permit a single signal broadcast by the originator to provide multiple stimuli to the intended recipients to enhance their ability to receive the signals using one of more of their aural, visual, and tactile senses. This feature would effectively overcome any physical disabilities or other limitations of some participants including language, providing an equivalent experience for all. Further, the physical implementation of specific embodiments should comprise a form familiar to the users and be easily configurable so that no additional skills or appreciable period of adaptation is required to transition from prior art systems to those taught herein.

SUMMARY OF SOME ASPECTS OF THE INVENTION

The scope of this disclosure is intended to encompass all embodiments related to the disclosed subject matter and for all useful purposes to which said embodiments may be applied. The embodiments listed herein are provided to be enabling rather than limiting, as persons of ordinary skill in a great variety of arts will immediately recognize how the apparatus, systems, and methods disclosed herein may readily be applied to aspects of their arts. For the purposes of this disclosure, it should be appreciated that the terms "a signal", "signals", and "signaling" are synonymous with the terms "a communication", "communications", "communicating", respectively, as providing a signal from an originator to a recipient (either intentionally or unintentionally) is a form of communication between the parties in every sense of the term. Further, signals and communications may both convey a discrete amount of information based on their nature and any pre-established understandings between the originator (s) and recipient(s). Finally, the term "communicates" should generally be interpreted to have the same meaning as the term "transmits", and vice versa, whether or not said communication comprises the exchange of data via electronic means as the term "transmits" customarily denotes. In this disclosure, any conveyance of information may be deemed to be either a "communication" or a "transmission", and a device performing said conveyance may be said to "communicate" or "transmit" without drawing any distinctions between those terms. Further, whenever the singular form of an object is used or implied, the use of the plural is understood to be included, and vice versa. For example, "signal receiving device" may refer to one such device or more than one such device. Terms denoting one or more, such as "signal receiving device(s)", are used herein for grammatical propriety where deemed applicable and are not to be distinguished from usage where only the singular or plural are used unless expressly stated otherwise.

In one embodiment of the invention, apparatus and systems are provided which electronically communicate at least one signal from an operator in possession of a signaling device, referred to as a signal originator, to one or more intended recipients, or users, each in possession of or with access to a receiving device. A signal originator activates a signaling device that generates and transmits a particular signal intended for a selected group of one or more receiving devices in the possession of users reasonably proximate to the signaling device. The extent of what is reasonably proximate to a signaling device is a function of many factors, including the magnitude of the signal leaving the signaling device(s), the sensitivity of the receiving devices, and a plethora of external factors affecting the signal's ability to propagate from the point of its origin to the receiving devices, including but not limited to electromagnetic interference, the relative elevation of the signaling device with respect to the receiving device, transmission path obstruction(s), and the like. For the purposes of this disclosure, the terms "reasonably proximate" and "in reasonable proximity to" applied to the relative location(s) of signaling devices and receiving devices refer to a physical separation between a signaling device and a receiver within the range of distances at which the signaling device may reliably communicate an intended or unintended signal to the receiving device, when both are utilized as intended, given the combined effect of all system characteristics and all external factors. Devices separated by a distance greater than that which permits reliable communication are not considered to be "reasonably proximate".

It is an object of this invention that the respective communication configurations of each of the signaling devices and each of the receiving devices will be highly adaptable and therefore possess a high degree of flexibility. As described elsewhere herein, the communication configurations of each device may be easily changed as desired by the users via any combination of mechanical or electrical means, including but not limited to the use of mechanical switches, configurable software or firmware, or by any other preferred means. Said configuration changes may be accomplished via any means of activating or altering the device's configuration, including at least one of any of direct manipulation, a wired connection, a wireless connection, a direct optical connection, a radiated optical connection, and the like. The extent to which certain communication configurations of one or more signaling device(s) may be compatible with communication configurations of one or more receiving device (s) is limited only by the embodiment(s) and characteristics implemented in the system as disclosed herein.

Each signaling device may be configured to communicate with more than one receiving device or more than one selected group of receiving devices. More than one signal originator may generate and transmit signals to one or more receiving device(s) or more than one selected group(s) of receiving devices using one or more signaling device(s). The receiving devices are configured to respond only to the signals transmitted by one or more particular signaling devices comprising a compatible communication configuration. Any signals transmitted by signaling devices with incompatible communication configurations will not cause the receiving device to respond and those signals will be ignored by the receiving device. Therefore, for the purposes of this disclosure, compatible configurations are those which permit a signaling device to successfully communicate with an intended receiving device as described more fully herein.

The communication configurations of each signaling device and receiving device may comprise at least one means for distinguishing signals from each other. Any known means by which a signal may be given a unique characteristic that permits is to be compared to and distinguished from at least one other signal is envisioned by this disclosure. By way of example and not limitation, communication configurations that may apply to this system includes distinguishing signal characteristics such as frequency, amplitude, modulated information, continuous wave transmission pattern(s), multiple carriers, and the like. More than one means of signal characterization may be simultaneously applied. One such non-limiting example is the use of a carrier waveform to transmit a modulated payload comprising any desired quantity of information using different modulation schemes. Multiple carriers at different frequencies may be employed using the same modulation scheme or different modulation schemes. Any useful combination of unique identification methods that may be applied to the signals transmitted by the signaling device(s) and are capable of being received and analyzed by the receiving devices to determine compatibility is within the scope of this disclosure.

The communication configuration of the signaling device may comprise any number of elements or characteristics necessary to successfully communicate with any number of desired receiving device communication configurations. In this sense, a "successful" communication is one that is recognized by a receiving device and causes an activation response to be generated by said receiving device. Similarly, the communication configuration of the receiving devices may comprise any number of elements or characteristics necessary to successfully receive communications from any number of signaling devices. It is only necessary that any particular signaling device and any particular receiving device share at least one element of their respective communication configurations to be compatible and therefore enable the receiving device to successfully receive an intended communication from the signaling device. The presence of a common element or characteristic in the respective communication configurations of the signaling device and the receiving device provides the necessary measure of compatibility between the two devices and enables communications between them. When the communication configurations of a signaling device and a receiving device do not comprise at least one common element or characteristic, the receiving device will not respond to any signal from the signaling device, as such communication would be deemed to be unintended as the communication configurations of the two devices would not be compatible. No successful communication would result.

For example, in one embodiment, a signaling device may comprise a communication configuration element that is compatible with receiving devices comprising only one particular communication configuration element. In this embodiment, the receiving devices are essentially dedicated to such signaling device because they will not respond to the signals of any other reasonably proximate signaling device.

In one embodiment, one signaling device may comprise a communication configuration compatible with the communication configurations of more than one group of receiving devices. Here, the communication configuration of the signaling device is compatible with more than one receiving device communication configuration, and a signal from the signaling device will activate all receiving devices with a compatible communication configuration even if the receiving device communication configurations of the various devices are not all identical. For example, the communication configurations of each of the receiving devices may comprise one or more element(s) not present in the communication configurations of other receiving devices, rendering each such communication configuration unique. However, the presence of one common element in each communication configuration will render all of them compatible with the communication configuration of a signaling device also comprising said common element. It is only necessary that one element of the communication configuration of a receiving device be compatible with one element of the communication configuration of a signaling device to receive communications therefrom. Identical and non-identical communication configurations or receiving devices may both be compatible with the communication configuration of a particular signaling device provided at least one common element is present in both.

In one embodiment, more than one signaling device may each comprise a unique non-identical communication configuration that is compatible with a single communication configuration shared by a group of receiving devices. Accordingly, more than one signaling device may communicate with the same receiving devices when the communication configurations of the signaling devices are identical because the communication configuration of each the several signaling devices, although not necessarily identical, are compatible with the shared communication configuration of the receiving devices. Compatibility exists when at least one common element is present in both communication configurations.

In one embodiment, more than one signaling device may comprise non-identical communication configurations and be compatible with more than one group of receiving devices that comprise communication configurations unique to that group but different from that of any other group. Each signaling device will be able to communicate with any one or more groups of receiving devices with non-identical or unique communication configurations if the communication configuration of the signaling device is compatible with the communication configuration of each such group.

It is generally envisioned that the receiving devices will be organized into groups with each such group sharing an identical communication configuration. However, this is seen as an advantage of the system in certain embodiments but is not limiting upon the scope of this invention in any manner. Rather than exist as members of a group with a shared communication configuration, in one embodiment none of the receiving devices will share a common communication configuration. This is identical to the case where the number of receiving devices in each group is limited to one. In this embodiment, each device within a group consisting of more than one signaling device and more than one receiving device may each comprise a unique, non-identical communication configuration. However, the non-identical communication configurations of certain receiving devices and those of certain signaling devices in this embodiment may be established to be intentionally compatible with each other by the presence of at least one common element to permit communication there between, despite the fact that none of the devices share an identical communication configuration. In this manner, any degree of selectable communication paths may be realized by users of the system. If the communication configurations of none of the signaling devices share at least one element or characteristic in common with the communication configuration of at least one of the receiving devices, no communications between any signaling devices and receiving devices will occur. However, providing communication configurations with at least one common element or characteristic will enable communications between devices so configured even though the communication configuration of those devices may comprise other elements in combination where no other device comprises the identical communication configuration. In other words, one common element or characteristic in the device communication configurations is both necessary and sufficient to enable communications between two devices, while the presence of other elements or characteristics not common to the communication configuration of those device are irrelevant.

When any reasonably proximate receiving device receives a signal for which it has been compatibly configured to respond, the receiving device responds by activating one or more forms of stimuli that the user in possession of the receiving device is capable of sensing. Only the subset of receiving devices within a larger population of reasonably proximate receiving devices comprising a communication configuration compatible with that of a particular signaling device will respond to signals from that signaling device. As above, more than one signaling device may comprise a communication configuration compatible with any particular receiving device, and said receiving device will respond to the signal of any such signaling device. In this manner, a first group of signaling device(s) and receiving device(s) sharing a first compatible communication configuration may be used in immediate proximity to, or even intermixed with, a second group of signaling device(s) and receiving device (s) sharing a second compatible communication configuration without confusion provided that the communication configurations of the first group and the second group do not comprise any common elements. Any number of different signaling device(s) and groups of receiving device(s) may be used in reasonable proximity provided that each group comprises a communication configuration not compatible with any of the others, where the number of groups is limited only by the number of available non-compatible communication configurations. In this manner, the signaling devices are not restricted to any particular geographic area. Multiple signaling devices are operative in an area proximate to any number of groups of receiving devices, and each receiving device will only be activated by the signal(s) received from the signaling device which shares a compatible communication configuration comprising a common element.

In some embodiments, the communications configurations are arranged in a hierarchal structure that permits compatibility between certain configurations for the purpose of organizing responses from the desired receiving devices. In this embodiment, certain signaling device communication configurations may permit compatible communication with more than one receiving device communication configuration according to an arrangement of groups and sub-groups.

In some embodiments, the signaling device(s) may be an electronic signaling device and the signal may be an electronic signal. In some embodiments, the electronic signal may be a signal transmitted through free space via electromagnetic field propagation, such as a radio frequency signal, or any combination of multiple electromagnetic field signals. In some embodiments, the signal may be transmitted via a wireless communication link such as, but not limited to, Bluetooth®, WiFi®, NFC, radio, visible and non visible light spectrums. In some embodiments, the electronic signal may be a conducted signal, such as a wired, fiber optic, or any other form of conducted electronic signal. In some embodiments, the electronic signal may be an infrared, optical, or other signal with a wavelength less than is generally regarded to be the extent of the radio frequency spectrum.

In some embodiments, the signal receiving devices may be electronic signal receiving devices capable of receiving an electronic signal generated and transmitted by an electronic signaling device.

In some embodiments, the signaling device(s) may be non-electronic signaling device(s) and the signal may be a non-electronic signal. In some embodiments, the non-electronic signal may be an audible signal. In some embodiments, the non-electronic signal may be a sub-audible, high frequency, ultrasound, or any other form of non-electronic signal.

In some embodiments, the signal receiving devices may be non-electronic signal receiving devices capable of receiving a non-electronic signal generated and transmitted by a non-electronic signaling device.

In some embodiments, non-electronic signal receiving devices may be configured to receive a non-electronic signal generated and transmitted by a signaling device and respond by activating one or more forms of stimuli that the recipient is better capable of sensing. While the use of this embodiment is not restricted in any way, it is particularly advantageous for hearing-impaired recipients who would not otherwise be responsive to any particular form of a non-electronic signal, such as an audible signal, but may be responsive to one or more other forms of non-electronic signals, such as vibration or illumination.

In some embodiments, the signaling device(s) may be combination electronic and non-electronic signaling device (s) and the signal may be a combination of one or more electronic or one or more non-electronic signals. In some embodiments, the electronic component(s) of the combination signal may be at least one of any of the electronic signals disclosed above. In some embodiments, the non-electronic component of the combination signal may be at least one of any of the non-electronic signals disclosed above. The electronic and non-electronic signals may be combined in any linear or non-linear manner, including but not limited to either signal being used to modulate the other via any linear or non-linear modulation scheme (amplitude, quadrature amplitude, pulse width, single sideband, frequency, phase, ampliphase, phase to amplitude, pulse code, pulse width, pulse amplitude, shift, keying, CW, intermodulation product, etc.), the superposition of either signal upon the other, or the like.

In some embodiments, the signal receiving devices may be combination electronic and non-electronic signal receiving devices capable of receiving combination electronic and non-electronic signals generated and transmitted by a combination electronic and non-electronic signaling device.

In some embodiments, the signaling device(s) may be configured to generate and independently communicate at least one electronic signal and at least one non-electronic signal. Said electronic signal(s) may be at least one of any of the electronic signals disclosed above and the non-electronic component of the combination signal may be at least one of any of the non-electronic signals disclosed above. However, in this embodiment, the electronic and non-electronic signals are not combined in any manner. The electronic and non-electronic signal(s) may be intended for reception by the same signal receiving device(s) or they may be intended for reception by different signal receiving device (s). In the latter embodiment, the signaling device(s) may utilize different communication configurations for each of the electronic and non-electronic signal(s).

In some embodiments, the signal receiving devices may be electronic and non-electronic signal receiving devices capable of receiving the uncombined electronic and non-electronic signals independently communicated by a combination electronic and non-electronic signaling device.

It is a preferred embodiment of this system that the signaling devices communicate directly with the receiving devices. However, in some embodiments, it may be desirable for the signals transmitted by a signaling device to be retransmitted from one or more other electronic devices to improve coverage within reasonable proximity of the signaling device, increase the usable range of the system, enhance the reliability of the communication system, or for other purposes.

In some embodiments, electronic signaling device(s) and electronic signal receiving device(s) may be communicable via an intermediate electronic station device. An electronic signaling device may communicate with the intermediate electronic station device which in turn may relay the communication to electronic signal receiving device(s), either by retransmitting the original signal received from the electronic signaling device in its original form or by modifying the original signal received from the electronic signaling device in any manner. In some embodiments, the intermediate electronic station device may serve to translate an electronic signal sent by an electronic signaling device with a first configuration into an electronic signal with a second configuration identical to or compatible with the configuration of one or more selected electronic receiving device(s). In some embodiments, an electronic signaling device may selectively communicate with more than one selected group of electronic receiving device(s) by altering the configuration of the intermediate electronic station device in lieu of altering the configuration of the electronic signaling device. In some embodiments, the configuration of the intermediate electronic station device may be selected or modified via an electronic reconfiguration signal sent by the same electronic signaling device currently in use for communication with the electronic receiving device(s). In some embodiments, the configuration of the intermediate electronic station device may be selected or modified via an electronic reconfiguration signal sent by any other electronic signaling device, via an automatic configuration selection device, via an external computing device, or manually. In some embodiments of this disclosure, an intermediate electronic station device may be considered to be an electronic signaling device, and all disclosure regarding the latter may apply to the former as well without limitation. In some embodiments of this disclosure, an intermediate electronic station device may be considered to be an electronic receiving device, and all disclosure regarding the latter may apply to the former as well without limitation.

In some embodiments, an intermediate electronic station device may direct electronic communications between an electronic signaling device and different groups of electronic signal receiving devices. For example, when individual members of a sports team have different duties, activities or positions relative to a particular situation or condition, each may be provided with one or more electronic signal receiving devices with different configurations. The intermediate electronic station device may be reconfigured via a signal from the electronic signaling device to match the configuration of the electronic signal receiving device(s) in the possession of the desired recipients and required signals for the different participants activities could be transmitted to address the condition via their devices or it could be coordinated by a secondary programmed device.

In some embodiments, an intermediate electronic station device may be configured to receive signals from more than one electronic signaling device and relay said signals to more than one group of electronic signal receiving devices. As described above, the intermediate electronic station device may relay these signals by retransmitting the original signal received from the electronic signaling device in its original form or by modifying the original signal received from the electronic signaling device in any manner. More than one electronic signaling device with more than one communication configuration may be in communication with an intermediate electronic station device at any one time. In this embodiment, the intermediate electronic station device may be configured to direct the incoming signals received from each electronic signaling device to one or more groups of electronic signal receiving devices as desired by the signal originator. In this manner, a single intermediate electronic station device may serve to relay signals from a number of electronic signaling devices to a number of groups of electronic signal receiving devices simultaneously. This is particularly advantageous when an intermediate electronic station device may be centrally located among various groups of electronic signal receiving devices at a favorable height above ground with a superior transmitting apparatus than is practicable for the electronic signaling devices themselves, as it will provide superior reliability due to improved propagation conditions.

Also as described above, the intermediate electronic station device may relay signals sent by an electronic signaling device with a first communication configuration using a second communication configuration, thereby enabling a high degree of flexibility in routing signals from any particular signaling device to any particular group of receiving devices only by varying the configuration of the intermediate electronic station device without varying the configuration of any electronic signaling device(s) or any electronic signal receiving device(s).

In some embodiments, an intermediate electronic station device may receive and relay signals received from at least one other intermediate electronic station device to electronic signal receiving devices, or it may receive and relay signals received from at least one other intermediate electronic station device to another intermediate electronic station device. In this manner, a series of intermediate electronic station devices may be communicatively connected to provide superior signal coverage and reliability throughout a large area within which a number of groups of electronic signal receiving devices are operative. As above, each intermediate electronic station device is capable of either relaying signals as originally configured or translating the configuration of any signals to a different configuration prior to relaying, if desired.

In lieu of an intermediate electronic station device, a receiving device may re-transmit a signal received from a signaling device in any embodiment where re-transmission is utilized. In one embodiment, the receiving device may transmit a signal from a signaling device that is compatibly configured. In this instance, the receiving device will both respond to the signal by activating its associated stimuli functions and re-transmit the signal according to one of several configurations. The signal may be re-transmitted by the receiving device according the communication configuration of the signaling device. Alternately, the receiving device may re-transmit the signal from the signaling device according to the communication configuration of the receiving device performing the retransmission. In yet another embodiment, the receiving device may re-transmit the signal from the signaling device according to a communication configuration not identical to that of the signaling device or the receiving device performing the retransmission. For example, the communication configuration of the signaling device may comprise other configuration elements not compatible with the communication configuration of the receiving device but compatible with other receiving devices. The communication configuration of the receiving device may also comprise other configuration elements not compatible with the communication configuration of the signaling device. In this embodiment, the receiving device may re-transmit the signal received from the signaling device according to a communication configuration that comprises only one or more of those configuration elements compatible with both the signaling device and the receiving device performing the re-transmission, thereby eliminating any undesired configuration elements present in the configurations of either of the signaling device or the receiving device. The re-transmitted signal would therefore only activate a response from other receiving devices that also comprise the configuration element(s) common to the signaling device and the re-transmitting receiving device.

In one embodiment, the receiving device may transmit a signal from a signaling device that is not compatibly configured. In this embodiment, the receiving device will generally re-transmit the original signal according to the original configuration of the signaling device without modification. A signal received from a signaling device utilizing a communication configuration that is not compatible with the communication configuration of the receiving device will not activate a response from that receiving device, but it may still be retransmitted without such activation. Any changes to the incoming signal may alter the original intent of the signal originator by either adding or eliminating configuration elements to that signal. However, any receiving device may re-transmit the incoming signal from an incompatible signaling device without alteration for the purpose of providing an additional signal available for reception by compatibly-configured receiving device reasonably proximate thereto. In this manner, any receiving device may serve as a source of retransmission of a received signal whether or not that signal was compatible with its own communication configuration.

In one embodiment, an electronic signaling device generates a carrier wave upon which information is modulated, such information corresponding to its communication configuration. Any form of modulation known in the art is envisioned by this disclosure, including but not limited to any linear or non-linear modulation schemes such as amplitude, quadrature amplitude, pulse width, single sideband, frequency, phase, ampliphase, phase to amplitude, pulse code, pulse width, pulse amplitude, shift, keying, CW, intermodulation product, superposition of one signal upon another, and the like. The carrier wave may be continuously generated, whether or not modulated information is imposed thereon, or the carrier may be generated only when a signal comprising modulated information is being transmitted.

In one embodiment, an electronic signaling device generates a carrier wave in small bursts of a duration sufficient only for the purpose of transmitting the information modulated thereon corresponding to its communication configuration. In this manner, transmission are minimized to reduce unnecessary clutter within the electromagnetic spectrum, thereby permitting other devices to communicate reliably on the same and immediately adjacent frequencies. Further, by limiting carrier wave generation to only those brief time periods necessary for communication purposes, device power consumption is reduced so device battery life will be extended. For multiple systems in close proximity, the ability of each system to operate reliably may be limited by electromagnetic transmissions of the other system(s) on the same or adjacent frequencies. Efficient use of the available spectrum will enable multiple systems to operate reliably in reasonable proximity when transmissions on the same or adjacent frequencies are minimized.

In one embodiment, an electronic signaling device generates a modulated carrier wave in small bursts as described above, wherein each burst is repeated more than once at predetermined or randomized intervals. The number of bursts is configurable from one to as many as deemed necessary to achieve reliable communications in any particular instance. Each bust preferably comprises all of the information necessary to convey the full communication configuration of the signaling device. However, in some embodiments, portions of the signaling device's entire communication configuration may be apportioned among more than one burst when it is desirable to limit individual burst duration while increasing the number of individual bursts. The intervals between such bursts may range from several microseconds to one second, such intervals determined by factors including but not limited to the carrier frequency, the number of bursts desired, the duration of the individual bursts necessary to convey the device's communication configuration or portion thereof, and the total period of time during which the system is permitted to transmit signals for a single signal origination event. This method provides redundant transmission of the signal to overcome the inevitable situation when more than one signaling device seeks to transmit simultaneously on the same or an immediately adjacent frequency. In the event that two signaling devices inadvertently transmit at essentially the same instant so as to overlap in time, the presence of both signals at the receiving device(s) may prevent either from being successfully received and demodulated. With only one modulated transmission, any reception or demodulation failure would prevent an intended communication from being successfully conveyed. By repeating the same burst transmission more than once, reception and demodulation of every such burst would have to be adversely affected to prevent successful communication. Increasing the number of identical transmissions within a short period of time is a reliable method of enhancing reliability. Any number of repeated bursts transmission may be provided, principally but not exclusively limited by the acceptable latency of the system (the time between initiation of a signal by the signal originator and the activation of stimuli by a receiving device) and the objective not to excessively pollute the RF spectrum with repeated identical transmissions that may serve no further useful purpose. In this and related embodiments, only one burst of modulated carrier need be successfully received and demodulated for successful communication. Once such a communication has been received, the receiving device is preferably configured to ignore any identical communications received within a specified period to avoid activating redundant responses.

In one embodiment, the bursts are transmitted at uniform intervals. The interval between sequential bursts is a configurable parameter within the signaling device's communication configuration. The utility of this embodiment is enhanced when each signaling device in reasonable proximity is configured with non-identical uniform intervals. Otherwise, when triggered simultaneously, each of the equally spaced repeated burst transmissions from multiple sources would coincide, likely resulting in interference to each burst.

In one embodiment, the bursts are transmitted at predetermined but non-uniform intervals. For instance, assume that the duration of each burst in this example is 25 ms. The transmission interval between the first and second bursts may be 120 ms, the interval between the second and third bursts may be 90 ms, the transmission interval between the third and fourth bursts may be 75 ms, and so on. The intervals between sequential bursts are configurable parameters within the signaling device's communication configuration. As with the previous embodiment, identical burst transmission configurations would likely result in a situation where interference to the initial burst is also encountered for each of the remaining bursts as well. However, two signals initiated at the same or at slightly different times have a reduced possibility of having every set of repeated transmission bursts coincide than with the uniform burst interval embodiment because it is unlikely that every burst in the set of repetitions will be coincident from both signaling devices.

In one embodiment, the bursts are transmitted at randomized non-uniform intervals. The signaling device selects a set of intervals at which to transmit the bursts of modulated carrier to be repeated as many times as desired. The minimum interval may be selected so that an entire burst may be transmitted by a second signaling device during the interval between burst transmissions from a first signaling device, and vice versa. As the intervals between bursts are randomly determined by each signaling device, it is increasingly unlikely that two independent signaling devices would be simultaneously activated to transmit a signal and that they would randomly select the same set of intervals between burst transmissions. Any difference in timing between the two signaling devices greatly enhances the chance that at least one burst from the signaling devices would be successfully received and demodulated by the desired receiving device(s) free of electromagnetic interference from the other.

In lieu of, or in conjunction with, the repeated burst embodiments described above, the signaling device(s) may employ more than one discrete frequency to transmit each burst or set of bursts of modulated information according to its communication configuration. Use of multiple frequencies or spread spectrum transmission techniques provide additional means for increasing the reliability of communication by further reducing the possibility that signals on the same frequency from more than one signaling device will be simultaneously incident at the receiving device and interfere with each other. The entire communication configuration may be transmitted as a single burst on one or more separate frequencies, or portions of the communication configuration may be transmitted as separate sets bursts on separate frequencies.

In one embodiment, the multiple burst signals described above are transmitted simultaneously on more than one frequency. An important consideration in utilizing multiple frequencies for simultaneous transmission and reception is that these frequencies be selected such that the occupied bandwidth of the modulated signal transmitted on each frequency not impinge upon the occupied bandwidth of any other signal being transmitted simultaneously. In this manner, the respective signals being transmitted will not interfere with each other.

In one embodiment, multiple frequencies are used to transmit burst transmissions sequentially rather than simultaneously. When separated by time, the likelihood that intermodulation products will result from the presence of any system nonlinearities is reduced, increasing system reliability.

When multiple frequencies are utilized, selection of such frequencies may be performed by the system user as an additional component of the communication configuration of each signaling device. Alternatively, the frequency selection may be performed be the signaling device via an algorithm, a look up table, or any other pattern generation methodology.

In one embodiment, the electronic signaling device(s) and electronic signal receiving device(s) may communicate using systems established for the distribution of alternating or direct current power. By way of example and not limitation, the system may utilize the commercial power grid as a propagation medium between the electronic signaling device(s) and the electronic signal receiving devices by coupling to and multiplexing its signal to a branch of the 50 Hz or 60 Hz power grid, said frequency dictated by locale. The electronic signal receiving devices are similarly coupled to a branch of the same power grid and configured to extract the electronic signaling device's original signal. This mode of signal propagation is often referred to as "common carrier" transmission. Significant advantages of these embodiments include the ability to communicate with a large number of electronic signal receiving devices at fixed locations with access to the power grid without the need for a radiated signal and associated RF spectrum footprint. However, these embodiments may not generally be suitable in situations where the electronic signal receiving devices are mobile and not directly connected to, or in close proximity to, the power grid.

In some embodiments, the electronic signaling device(s) may communicate with the electronic signal receiving devices via a "broadcast" scheme. That is, the electronic signaling device(s) are configured to transmit signals capable of being received by any compatible device sufficiently proximate to the electronic signaling device(s). No attempt is made in during the specific act of transmission to discriminate between intended and unintended devices. All determination of whether a particular receiving device is an intended recipient of a communication from a particular signaling device is made by that particular receiving device based on whether its communication configuration is compatible with that of the signaling device. As disclosed above, only those electronic signal receiving devices properly configured to respond to any particular signal transmitted by electronic signaling device(s) of a common communication configuration will do so. In a broadcast scheme, the electronic signaling device(s) operate without knowledge of which, if any, electronic receiving devices are configured to receive its signals or if any such devices are sufficiently proximate to the electronic signaling device(s).

In addition to the use of compatible communication configurations to discriminate between intended and unintended receiving devices, in some embodiments the electronic signaling device and the electronic signal receiving devices may be configured to connect using a specifically-established communication link, including but not limited to those established via a mutual pairing process. This additional link configuration is envisioned to be utilized in conjunction with, and not in lieu of, the use of compatible communication configurations for message discrimination taught above. Established link configuration embodiments may be characterized by the presence of a pre-communication association process wherein the electronic signaling device presents a signal to the electronic signal receiving device(s) and, at a minimum, each electronic signal receiving device must be individually configured to authorize reception from that particular electronic signaling device. In some embodiments, each of the electronic signaling device (s) and the electronic signal receiving devices transmit and receive any data and acknowledgements necessary to establish and maintain said communication link. In such embodiments, each of the electronic signaling device and the electronic signal receiving device may configured to require authorization prior to the establishment of communication between the two devices. In some embodiments, only one of the electronic signaling device(s) or the electronic signal receiving devices transmits and receives, while the other device only receives, any data and acknowledgements necessary to establish and maintain said communication link. In some embodiments, only one of the electronic signaling device(s) or the electronic signal receiving device(s) transmits, while the other device only receives, any data and acknowledgements necessary to establish and maintain said communication link. In an embodiment of a specifically-established communication link scheme, each electronic signaling device is aware of any devices with which it is presently associated and may detect and report operational data, including but not limited to the number and identity of devices to which it is presently or has been previously connected and the relative signal strength associated with each such connection. In certain embodiments where the electronic signaling device(s) are configured to receive communications from electronic receiving device(s) related to link establishment or link maintenance, the electronic signaling device(s) may also obtain data from the electronic receiving device(s) regarding relative signal strength received by the electronic receiving device(s) from said electronic signaling device(s).

In embodiments which utilize specifically-established communication links, all electronic signal receiving devices not intentionally associated or paired with a particular electronic signaling device will not be responsive to communications from the electronic signaling device. As a non-limiting example, the spread-spectrum communication protocol technology known as Bluetooth® utilizes a pre-communication pairing authorization scheme which, according to this disclosure, may be extended to any reasonably similar mode of communication without limitation. In addition to or in lieu of this method, any other protocol or authorization scheme which establishes and maintains a specifically-establish communication link is envisioned by the scope of this disclosure.

In one embodiment, electronic communications between the signaling device(s) and receiving device(s) may be administered via the use of a media access control (MAC) address protocol using industry-standard MAC addresses presently assigned to every piece of computer hardware with network communication capability. While the use of a MAC address access scheme would comprise an additional component of each devices' communication configuration, the assignment of MAC addresses is generally performed as a means of identifying a particular hardware device on a quasi-permanent basis and is not intended to be variable to the same extent as are the other communication configuration element of this system. Unique MAC addresses may be assigned to each device and the ability or inability to successfully communicate between respective devices may be controlled via these addresses. For example, a table of the MAC addresses of each signaling and receiving device in a particular set of devices could be stored in each device, and each device would consult said table as a precondition of responding to any received signal. If a signal is received from any other device with a MAC address not present in the table, such signal would not activate a response even if the transmitting device's communication configuration is otherwise compatible with that of the receiving device. A table or other resource of MAC addresses could be used to authorize connections to certain devices (typically referred to as "white listing") or to prohibit connections to certain devices (typically known as "black listing"). Use of such MAC address systems would further reduce the possibility of signaling communication confusion between separate systems operating in reasonable proximity. In the event that two or more systems operating within the same general area are unknowingly configured with the same communication configurations, a device from one system may inadvertently activate a response from a device in another system. The ability to restrict communications to a chosen desired set of receivers is an additional benefit for certain embodiments, providing the users of each system with the means to eliminate the possibility of inadvertent responses to spurious signals from other systems. Where such restrictions are unnecessary or undesired, the MAC address restriction scheme could be disabled if desired.

In lieu of, or in addition to, the use of a MAC address restriction scheme, the communication configuration of each device may comprise an electronic identifier unique to the units of this invention. In this manner, a unique industry-standard MAC address would not need to be obtained for and assigned to every device in every system. Such electronic identifiers could be utilized in a manner identical to that of MAC addresses or in any other useful way to achieve or enhance the communication capability of the devices in this disclosure. With respect to schemes based on either MAC address restriction or other electronic identifier restriction, these parameters are envisioned to be a component of the device(s) communication configuration and as easily configured as any other parameter therein.

In some embodiments, the signaling device(s) may be configured to direct the signals generated and transmitted in all directions equally via a non-directional transmitting apparatus. In practice, and due largely to incidental and unintentional effects, some degree of directionality will generally result from the use of a non-directional transmitting apparatus. However, this embodiment is principally directed to the case when the transmitting apparatus comprises no intentional means or methods that would provide a non-uniform signal. In some embodiments, the signaling device(s) may be configured to direct the a greater portion of the signals generated and transmitted in one or more particular directions and to direct a lesser portion of signals generated and transmitted in one or more other directions via a directional transmitting apparatus. Broadly applied, providing signals of equal magnitudes to a non-directional transmitting apparatus and to a directional transmitting apparatus results in the directional transmitting apparatus providing a greater signal in certain directions and a lesser signal in other directions than the non-directional transmitting apparatus generally provides in all directions.

Each receiving device is configured to respond to signals transmitted in accordance with its communication configuration by activating one or more forms of stimuli that the recipient is capable of sensing. By way of example and not limitation, said stimuli may include, for example, audible signals, visible signals including but limited to illumination, haptic or kinesthetic stimuli signals such as vibrations or pulses capable of being sensed by the user, a low voltage signal applied between two points on the user's skin that induces a discernable but harmless sensation for the user, and the like. Any combinations of one or more of the foregoing, as well as any other useful forms of stimuli, are envisioned by this disclosure. The various stimuli may be provided in an uninterrupted manner for a limited duration or provided for a number of shorter periods within a limited duration. Upon activation, the stimuli may continuously provided for a certain duration and then stopped. In an illustrative but non-limiting example, a buzzer may sound for 1-3 seconds and then stop, the receiving device may vibrate for a comparable period and then cease vibrating, or both may be simultaneously provided. As another non-limiting example, the buzzer may sound for 250 ms periods separated by 250 ms periods of silence for a 2-4 second duration. Similarly, a light on the receiving device may light continuously or, alternatively, blink on and off for a certain period. Such preferences are envisioned to be configurable for each device as needed or desired by the system users and operators.

By way of example and not limitation, implementations of these and other embodiments of the invention may include one or more of the features described in detail below and elsewhere herein.

The signaling devices may comprise any form(s) suitable for the intended purposes. In one preferred embodiment, the signaling device is comprised within an enclosure resembling a conventional whistle ubiquitous in sports and recreational activities. In the embodiment where the signaling device is an electronic signaling device, all of the necessary electrical and mechanical components are provided in said enclosure. In other embodiments, the signaling device may take the form of a hand-held electronic device comprising any of a touch screen display, buttons, switches, and any other components best suited for the particular application and environment in which it is to be used. For specialized applications, the signaling device may be fabricated in any unconventional shape or configuration best suited for the particular requirements of said application. Further, it may be designed to be held by, worn by, attached to, or incorporated into other items of clothing, equipment, or other effects of the user in any manner best suited for its purpose.

The process of initiating a signal using a signaling device may comprise any desired manner of physical, analog, or digital input. In the embodiment where the signaling device is a configured in the form of a whistle, a signal may be initiated by blowing into the device which activates one or more mechanical or electromechanical devices as described in greater detail below. When the signaling device comprises a different form, signal activation may be performed by any desired action or combination of actions for which the device is specifically designed, including but not limited to at least one of any of pushing, pressing, tapping, squeezing, pinching, shaking, twisting, and the like.

The receiving devices may also comprise any preferred physical form or shape. In one preferred embodiment, the receiving devices comprise a small semi-rectangular unit that may be attached to a user in an unobtrusive but convenient manner. For example, in a non-limiting manner, the receiving device may be attached to a uniform, jersey, jacket, headband, wrist band, lanyard, collar, strap, etc. worn by the user. Attachment means include, but are not limited to, the use of high strength magnets, pins, adhesives, hook and loop fasteners, or enclosure of the device within a pocket or special accommodation, such as a pouch or a flap, on the external garment(s) of the user. Any means by which a user may beneficially, comfortably, and effectively retain possession of the receiving device while engaged in a primary activity is envisioned by this disclosure.

The signaling and receiving devices may be separate from, or incorporated into, other wearable items of technology such as biometric wristbands, heart monitoring chest straps, other forms of biosensing apparatuses, and the like.

The visual displays for the signaling and receiving devices and the intermediate electronic station may be comprised of any usable displays or lighting devices known in the art, including but not limited to incandescent lights, light emitting diodes (LEDs), liquid crystal displays (LCDs), organic LEDs (OLEDs), electronic Ink, plasma displays, and the like.

The audible stimuli output for the signaling and receiving devices may be provided by any known devices, included but not limited to buzzers, speakers, piezo devices, and the like.

The tactile stimuli output for the signal and receiving devices may be provided by electric current, haptic devices that vibrate, provide a physical impulse signal sensed as a tap, or the like.

The signaling and receiving devices may be held by a user, worn as an attachment to garments, uniforms, or sports equipment, or they may be incorporated into hats, shirts, pants, shoes, earmuffs, collars, tops, socks, gloves, and the like.

The signal and receiving devices may be powered by a replaceable battery or, preferably, one that may be recharged without removal from the device. Battery charging may be accomplished by a wired connection, by a contactless inductive charging system, by a photovoltaic cell, or by an internal mechanism configured to convert mechanical energy into electrical energy.

In some embodiments, at least one of any of the electronic station, electronic signaling devices and electronic receiving devices may store and use environment information. As one non-limiting example, in a training scenario, a participant's environmental conditions may be stored and compared to biometric response data relative to signals sent to and received by the participant to look for reaction time or some other performance metric.

In some embodiments the electronic signaling devices and electronic receiving devices may be physically or virtually linked to biometric devices. As one non limiting example, a signal receiving device could be attached to a wrist band that monitors pulse or other performance characteristics.

In some embodiments the intermediate electronic station may store information pertaining to the operation of the system, including but not limited to a log of the dates and times of all messages sent or received by any electronic device in the system or any other useful operational information. This data may be captured by the device(s) and later transferred to external devices or systems for analysis.

In some embodiments, the signaling devices and the signal receiving devices may have an electronic display device to present useful information to the user, including but not limited to the configuration of the device, battery life, operational status, or to provide additional visual signaling means.

It is a principal advantage of the apparatus, systems, and methods of the invention described herein that certain embodiments provide flexible and highly configurable signaling and communication in an environment where multiple instances of this technology are simultaneously deployed. In lieu of the confusion created when standard signaling methods such as whistles, buzzers, bells, and the like are utilized in close proximity and the intended recipients of those signals cannot be certain that the signal they heard was meant to apply to them, this system provides novel technology that eliminates any confusion as to which signal pertains to which intended recipient or group of recipients.

Another principal advantage of the system described herein is its inherent flexibility to allow users to modify the communication configurations of both the signaling and receiving devices to achieve any useful purpose or to avoid undesired interaction between multiple instances of the system operation in close proximity. The signaling and receiving devices are readily configurable to meet any desired objective via any combination of desired means according to the chosen criteria for such configurations.

A further principal advantage of this invention provides for the activation and delivery of different stimuli to the intended recipients in addition to, or in lieu of, the conventional aural signal provided by whistles, buzzers, bells, and the like. Depending on the distance from the source of a conventional aural signal and external factors such as ambient noise, wind direction and velocity, or even the partial or full hearing impairment of an intended recipient, a conventional aural signal may not be sufficiently discernible in the face of such obstacles to reliably capture the attention of all intended recipients. By providing a personal receiving device configured to provide at least one alternate form of stimuli to the recipient as disclosed herein, including a flashing light, a vibration, an amplified aural signal emitted from the personal device in their possession, or any combination thereof, intended recipients will be certain to receive all signals intended for them.

An additional advantage of some embodiments of the invention disclosed herein is the capability to quickly and effectively deliver signals from an originator to a select group of individuals on a personalized basis. Depending upon the communication configuration of the various receiving devices in the system, a group of intended recipients, or even an individual recipient, may be selected from the set of the whole and a signal provided exclusively to that group or individual as desired without activating a response from the receiving device(s) of any other recipient(s), thereby signaling only the desired party or parties.

Other advantages of the invention and its application for other useful purposes will become apparent to a person of ordinary skill in the art based on this disclosure, and all such embodiments are envisioned thereby.

BRIEF DESCRIPTION OF THE DRAWINGS

Without limiting the invention to the features and embodiments depicted, certain aspects this disclosure, including the preferred embodiment, are described in association with the appended figures in which.

DETAILED DESCRIPTION OF SOME EMBODIMENTS OF THE INVENTION

Figure 1:
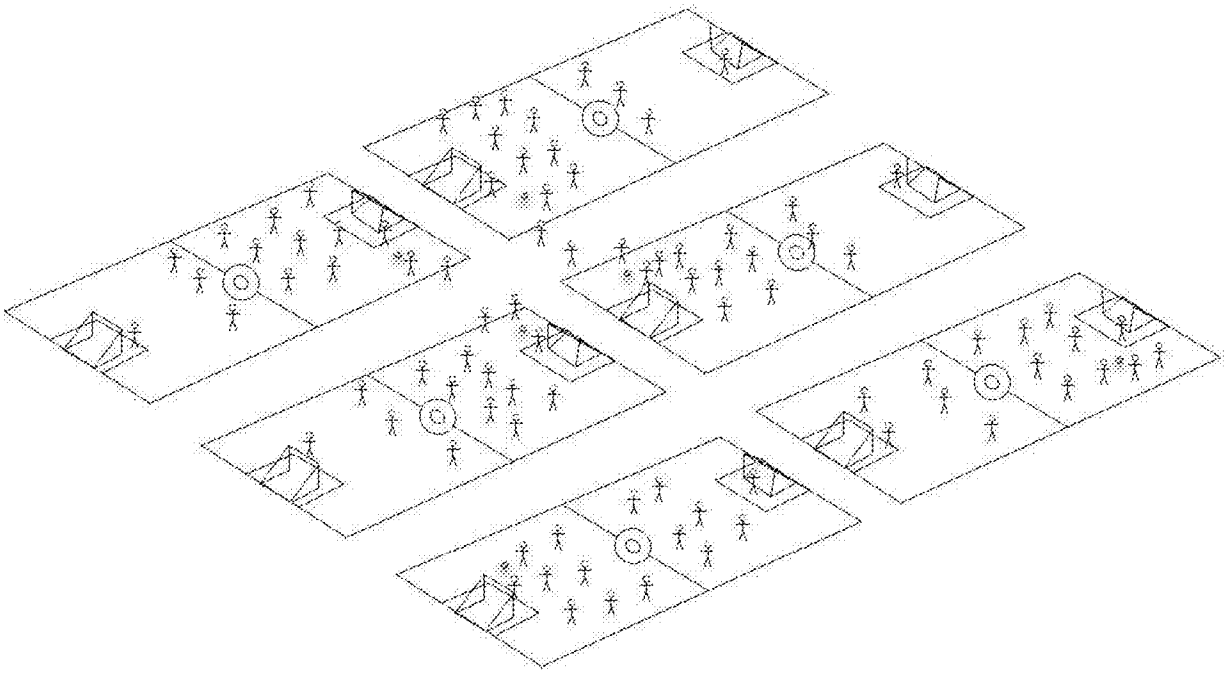
Figure 1 Prior Art
FIG. 1 is a depiction of the present practice of grouping multiple sporting events, particularly those involving younger participants, in close proximity where the use of prior art signaling devices may result in confusion among participants in adjacent but different activities.
Figure 2A:
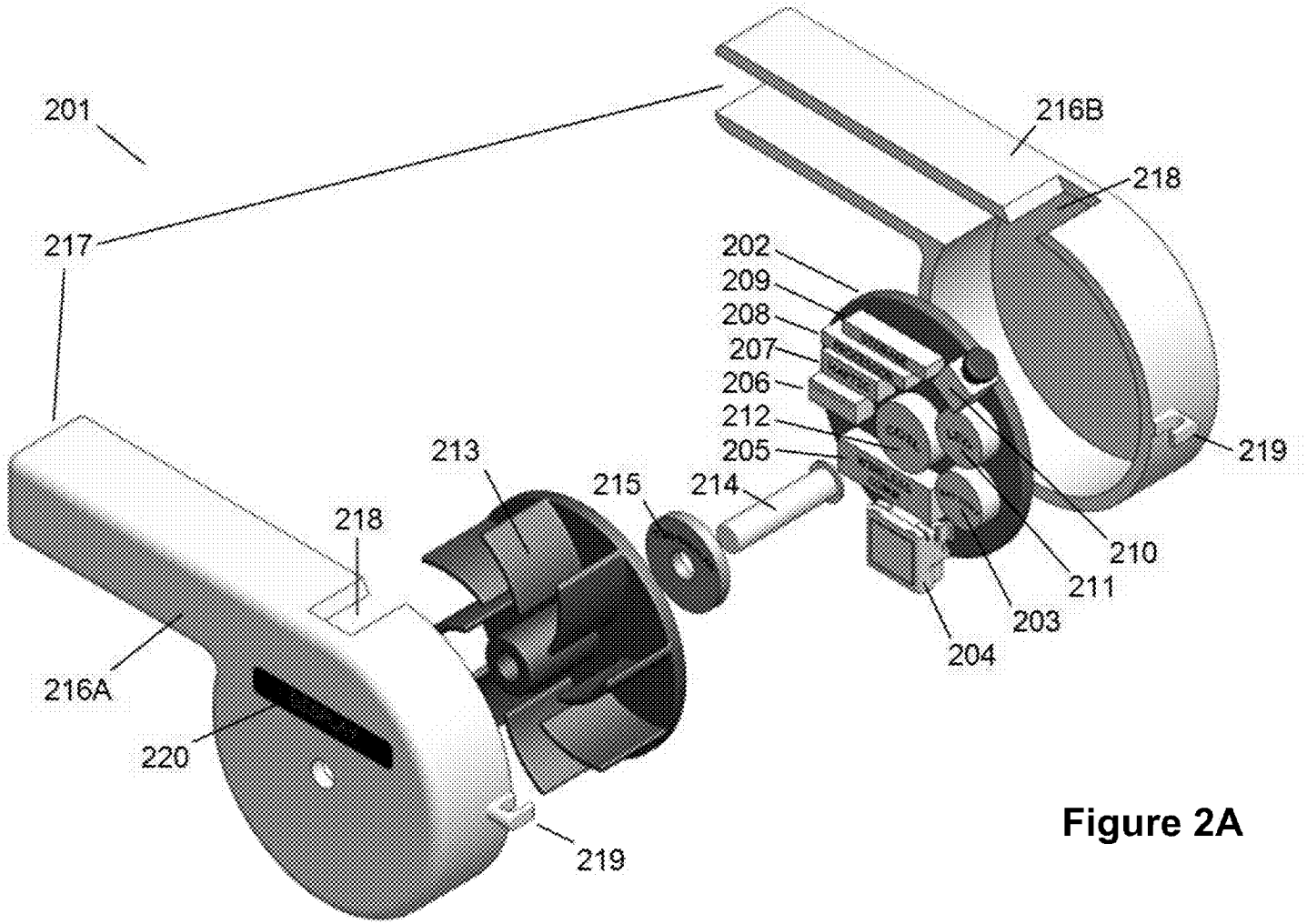
FIG. 2A is an exploded view of one embodiment of a signaling device of the present invention.

One embodiment of a signaling device 201 is depicted in FIGS. 2A through 2D. Each element which comprises signaling device 201 is identified with the same reference character throughout FIGS. 2A through 2D. In this embodiment, the signaling device is configured to resemble a traditional breath-activated whistle for ease of use and familiarity to the user. FIG. 2A provides an exploded view of signaling device 201 that comprises a circuit board 202 further comprising numerous components and subsystems, including but not limited to one or more batteries represented by exemplary battery 203. Preferably, said battery is a high capacity rechargeable battery, such as but not limited to one of any of lithium-ion (Li-on), nickel cadmium (NiCd), nickel metal hydride (NiMh), lithium ion polymer (Li-on polymer), or nickel lithium (NiLi).

Signaling device 201 may also comprise one or more connectors, jacks, or hardware connection points represented by exemplary jack 204 and one or more wired or wireless communication module(s) represented by exemplary communication module 205. Said communication module 205 may comprise one or more wired or wireless ports and be configured to provide wired, wireless, or wired and wireless communication. More than one communication module 205 may be provided by signaling device 201 to permit communication via any known or later-developed wired or wireless communication technologies or protocols, including but not limited to serial (USB), Bluetooth®, ZigBee®, Wi-Fi® (generally comprising the family of IEEE 802.11 protocols), Near Field Communication (NFC), and the like. Multiple connections may be established using the same communication technology or protocol, or more than one communication technology or protocol may be used simultaneously for similar or different purposes. When communication module 205 is configured to communicate via a wireless technology or protocol, signaling device 201 will further comprise one or more suitable antenna(s) (not shown) in the form of a planar antenna affixed or structurally integrated into the structure of signaling device 201 or a planar or non-planar outboard device or apparatus, such as a radiating element configured as a lanyard. Any known technology suitable for this purpose is envisioned by this disclosure.

The wireless communication module(s) 205 of signaling device 201 are preferably, but not necessarily, configured for two-way communication. The ability to transmit a signal is the primary function of said signaling device, but the ability to receive wireless communications will provide enhanced operational and configuration control of the signaling device. For example, the communication configuration of signaling device 201 may be established and adjust as necessary via a wired connection applied to one or more of the jack(s) 204. However, in one embodiment where the signaling device comprises two-way wireless communication means, communication configuration of the signaling device may also be performed via said wireless communication means.

Signaling device 201 further comprises one or more piezoelectric device(s) 206, one or more haptic devices 207, at least one processor 208, one or more memories represented by exemplary storage element 209, at least one control button 210, one or more lights of any desired type, represented by LED 211, and a stationary component of a power generating subsystem represented by inductor coil 212. Signaling device 201 may further comprise additional internal components including but not limited to an impeller 213, a shaft 214 upon which impeller 213 may rotate, and one or more magnet(s) represented by magnet 215, typically affixed to impeller 213 such that said magnet(s) and impeller rotate together with respect to stationary inductor coil 212 or its functional counterpart. The internal components of signaling device 201 are enclosed within a shell or other enclosure, depicted here in two halves 216A and 216B joined along the center seam of the assembled signaling device and preferably comprised of a durable plastic, other synthetic material, or metal for durability and protection of the internal components. In this embodiment, said shell comprises an air inlet 217 and an air outlet 218, an attachment point 219 for a lanyard, and one or more windows represented by window 220 to permit a user to inspect the internal components without opening the shell. In one embodiment (not shown in FIG. 2A), signaling device 201 may further comprise one or more electronic displays comprising one of any of LED, LCD, OLED, incandescent, or any other indicators or electronic display elements preferred in a specific application. Said display may be disposed at the location shown for window 220 or at any other preferred location on the signaling device.

Figure 2B:
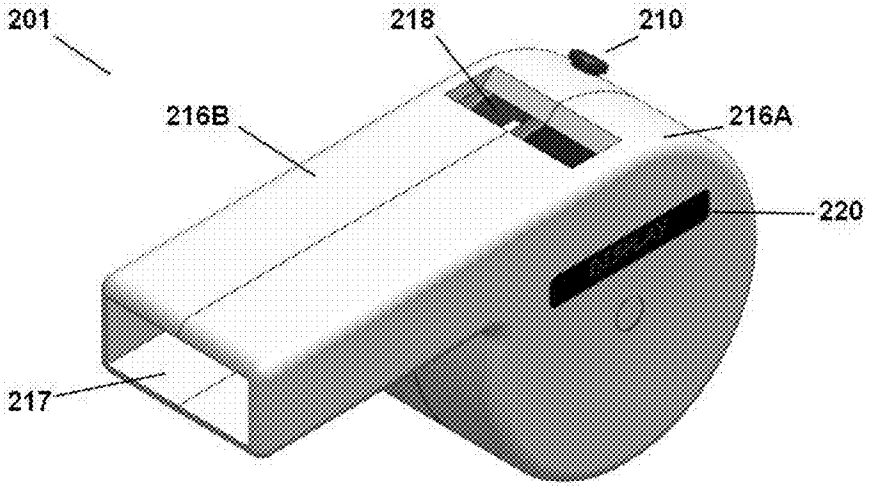
FIG. 2B is a non-exploded view of the embodiment of the signaling device presented in FIG. 2A.
Figure 2C:
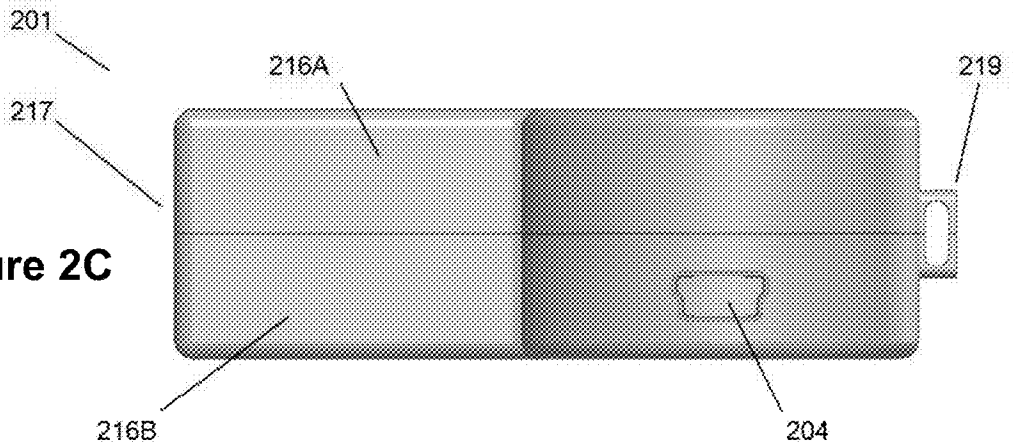
FIG. 2C is a view of the bottom surface of the embodiment of the signaling device presented in FIG. 2A.

A perspective view revealing one side and the upper surface of the assembled signaling device 201 of FIG. 2A is shown as FIG. 2B. In FIG. 2C, the bottom of signaling device 201 is shown with exemplary connector 204 (in this embodiment, a female Type Mini-A USB connector).

Figure 2D:
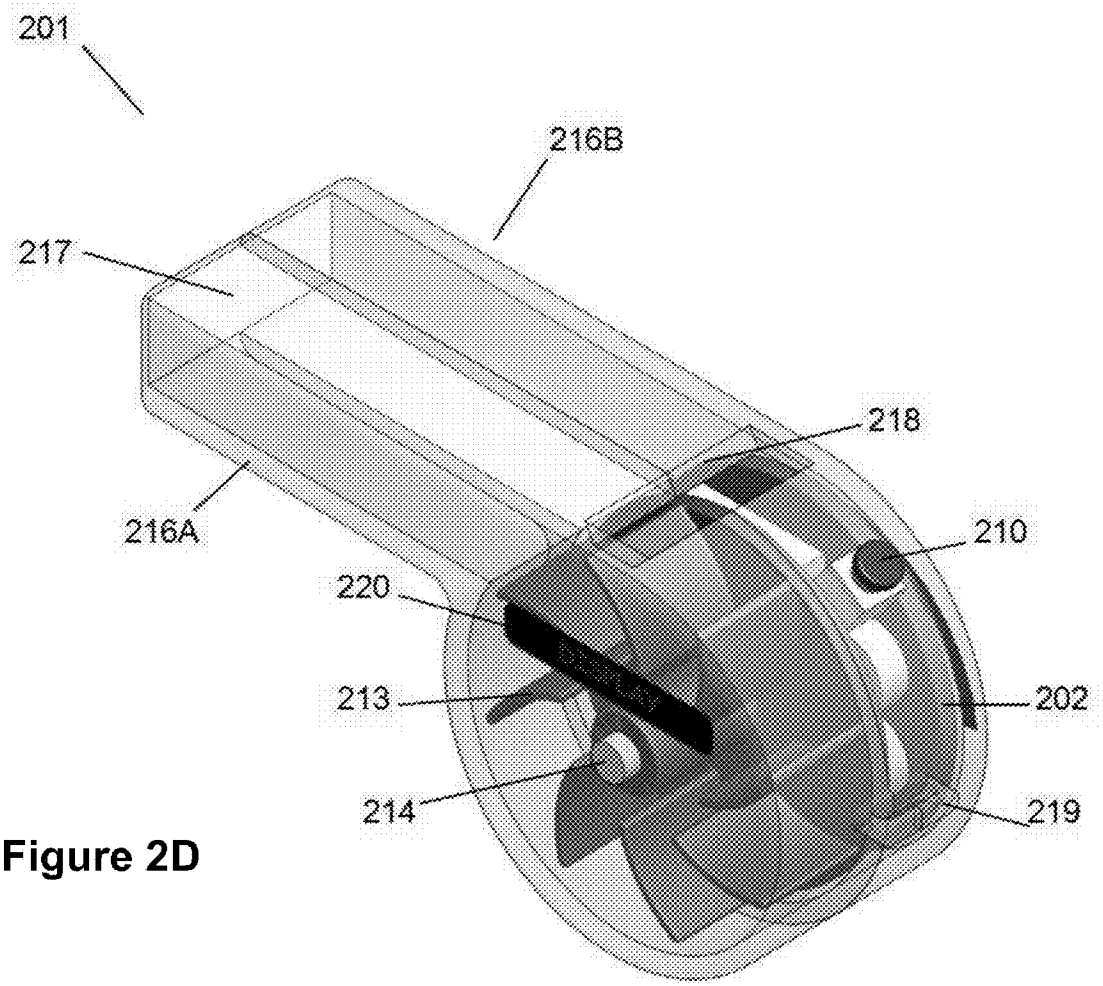
FIG. 2D is a non-exploded view of the of the embodiment of the signaling device presented in FIG. 2A comprising a transparent enclosure.

FIG. 2D comprises a perspective drawing of the assembled signaling device 201 with a transparent enclosure, revealing a portion of the internal components described above. Said signaling device may be fabricated with a transparent enclosure as shown here or may be fabricated with an opaque enclosure as may be preferred. Not all elements described with respect to the previous figures are visible in FIG. 2D, but the combination of all figures accurately and thoroughly depicts this particular embodiment of signaling device 201.

In operation, the one or more processor(s) 208 and storage/memories 209 comprise a computing device in communicative control with all of the other peripheral elements of assembled signaling device 201 described elsewhere herein. Storage/memories 209 may comprise any combination of RAM, ROM, EPROM, EEPROM, flash memory, or other devices preferred for temporary or persistent storage of data. Communication module 205 is preferably in data exchange communication with processor(s) 208 and configured to send and receive data via wired connections through jack 204. Communication module 205 preferably also comprises wireless communication capability and one or more wireless communication ports through which outbound wireless signals may be transmitted via the one or more antenna(s) to one or more receiving devices.

In the embodiment depicted in FIGS. 2A-2D, power is provided to the active components via one or more rechargeable batteries 203. In one embodiment, said batteries 203 may be charged via connection to one of the one or more jack(s) 204 which may preferably be a USB jack. In another embodiment, signaling device 201 may comprise an on-board charging subsystem comprising the impeller 213, magnet 215, and stationary component such as inductor coil 212 depicted in FIG. 2A. When the user blows into air inlet 217 in a manner identical to the use of a conventional whistle, impeller 213 and magnet 215 rotate about shaft 214, imposing a time-varying magnetic field proximate to inductor coil 212, thereby generating current at a low voltage that may be applied to charge one or more batteries 203. Additionally, signaling device 201 may further comprise one or more capacitors (not shown) of any known type or configuration to which the voltage from any charging device connected via the one or more jack(s) 204, or the voltage generated by the on-board charging subsystem, may be applied to store charge as an additional reservoir of electric power for operation of the signaling device.

In one embodiment, inductor coil 212 is configured for use with a contactless inductive charging system described in greater detail below. In this embodiment, the presence of a time-varying electromagnetic field (particularly the magnetic field component) generated by said charging system induces a current in inductor coil 212 that is conveyed to the one or more charge storage elements disclosed above, including but not limited to one or more batteries 203 or one or more capacitors. Inductor coil 212 may be configured for use with impeller 213 and magnet 215 alone, configured for use with a contactless inductive charging system alone, or configured for use with both impeller 213 and magnet 215 and with a contactless inductive charging system.

In one embodiment, the current generated by rotational motion of impeller 213 and magnet 215 when a users blows into air inlet 217 is communicated to processor(s) 208 as the command to generate and transmit a signal according to the communication configuration of signaling device 201. When such command is received, processor(s) 208 may retrieve the necessary communication configuration information from storage/memory 209, generate the appropriate instruction, and communicate said instruction to at least one of the communication module(s) 205 for transmission. In one embodiment, separate means may be provided by which to sense rotational motion impeller 213, including but not limited to a separate switch, in lieu of using the voltage generated by the on-board charging subsystem to command a signal transmission.

In one embodiment, the one or more control button(s) 210 may also be used to generate a command to processor(s) 208 to generate and transmit a signal according to the communication configuration of signaling device 201. In one embodiment, the one or more control button(s) may also be used to generate a command to processor(s) 208 to modify a command provided to processor(s) 208 via the voltage generated by rotational motion of impeller 213 and magnet 215, thereby generating and transmitting a different signal than would be transmitted upon receipt of a command from either the impeller/magnet voltage or from the control button 210.

In one embodiment, the one or more control button(s) 210 may be configured to turn signaling device 201 on and off, provide a means to switch the signaling device from an operating mode to a configuration or set-up mode in which the signaling device's communication configuration may be entered or modified, or perform any other function useful to the operation of said signaling device. Control button(s) 210 may also serve as a means to activate a self-test function for the signaling device to verify that the battery is charged and the display and all of the stimuli-causing components are functioning properly, and may also be configured to activate any number of functions in response to specific patterns, such as one short press, some number of short presses within a certain time, one or more longer duration presses, combinations of short and longer presses, and the like.

Any of the haptic device(s) 207, LED(s) 211, and piezoelectric element(s) 206 may be configured to provide vibration, visual, or audible output, respectively, to the operator of signaling device 201 for any useful purpose.

Figures 3A, 3B:
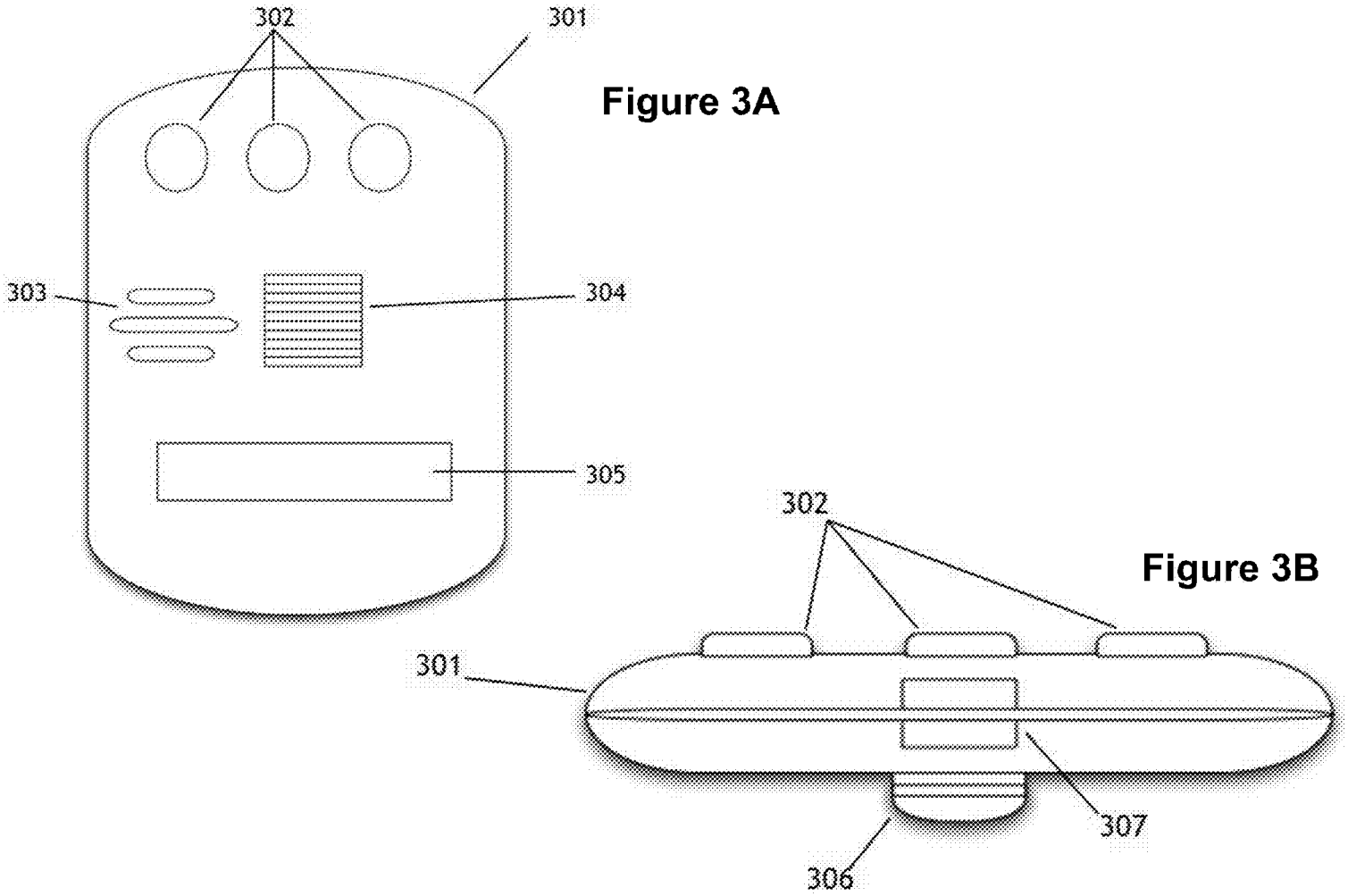
FIG. 3A is a frontal view of one embodiment of a receiving device of the present invention.
FIG. 3B is a bottom view of the embodiment of a receiving device depicted in FIG. 3A.

One embodiment of a receiving device 301 is depicted in FIGS. 3A through 3D. Each element which comprises receiving device 301 is identified with the same reference character throughout FIGS. 3A through 3F. FIG. 3A depicts the front planar view of receiving device 301, which comprises an enclosure, preferably fabricated from a high impact plastic or other suitable material, and various components necessary or desirable to implement the functions of said receiving device. To provide stimuli to the user when the receiving device is activated upon receipt of a compatibly configured signal, the receiving device comprises one or more externally mounted visual indicators 302 which may be LEDS or other lighting devices sufficient to visually alert the user. When more than one visual indicator 302 is utilized, they may be configured to flash in unison or in any other desired sequence (progressive left to right, progressive right to left, alternating flashes between sets of indicators, randomly, or the like). In addition, the enclosure comprises an opening or other means 303 to permit sound from an internally-mounted aural alerting component, such as a piezo electric buzzer, a speaker, or any other device capable of generating an audio signal of sufficient volume, to pass through the enclosure and audibly alert the user. In some embodiments, the receiving device may be powered wholly or partially by a small photosensor collector 304 to convert light energy into current at low voltage suitable for storage and later use by the receiving device. For obvious reasons, any such photosensor collector 304 must be mounted externally as depicted or in a similar manner for exposure to light. The receiving device 301 may also comprise a display 305 to provide various useful information to the user, including but not limited to the receipt of a compatibly configured signal from a receiving device, the on or off state of the receiving device, the state of charge of the internal battery and any other power components, or any other useful information pertaining to the operational state of the receiving device.

A bottom view of receiving device 301 is provided as FIG. 3B. Connector 307 provides a wired point of connection for the purpose of exchanging data with the receiving device, including but not limited to establishing or modifying the communication configuration of the receiving device, sending other data to or retrieving data from the receiving device, loading or updating firmware to the receiving device, and the like. The wired connector 307 may also be utilized to charge the internal batteries 313 of the receiving device. In one embodiment, the connector is a female connector suitable for use with the universal serial bus (USB) protocol, permitting both the transfer of charging power to the receiving device and the simultaneous exchange of data therewith. In another embodiment, the connector may be any connector suitable for the desired purpose(s).

Figure 3D:
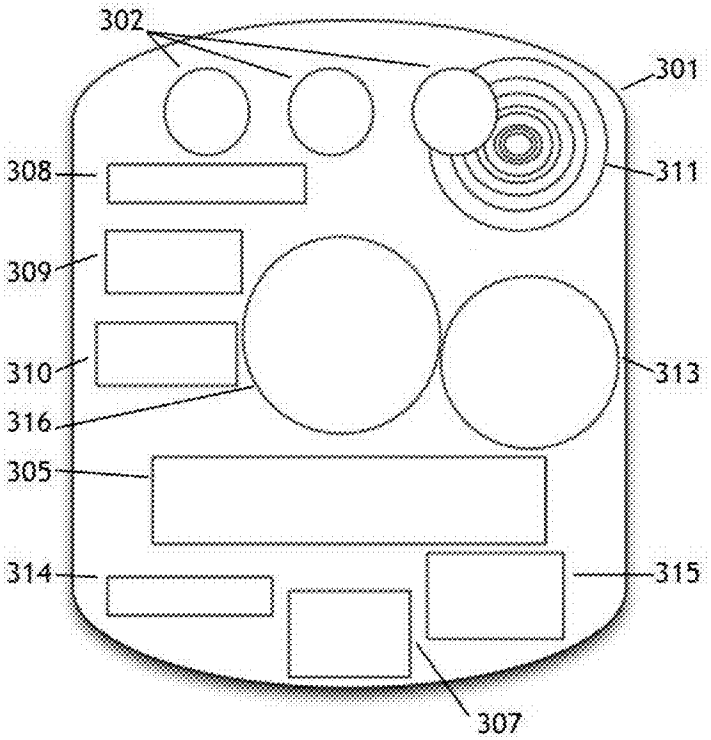
FIG. 3D is a view of the embodiment of a receiving device depicted in FIG. 3A with the front surface of the enclosure removed to reveal its internal components.
Figure 3C:
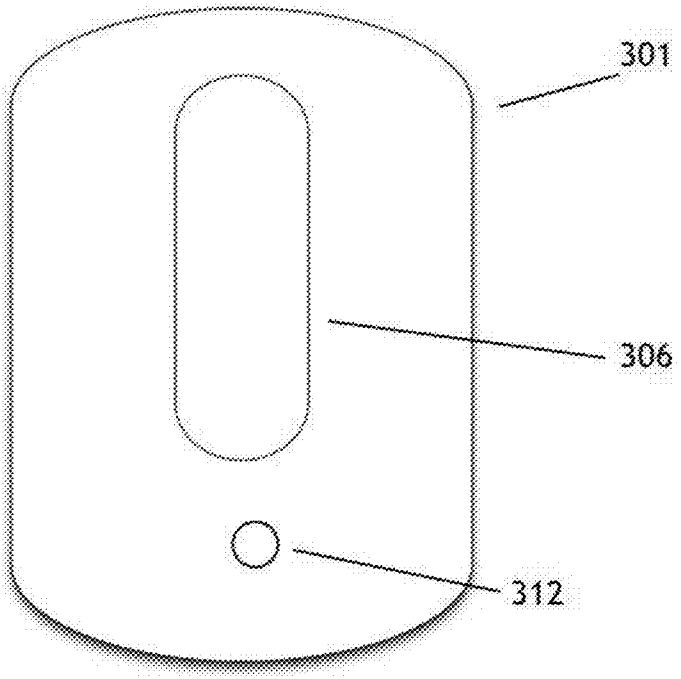
FIG. 3C is a rear view of the embodiment of a receiving device depicted in FIG. 3A.
Figure 3E:
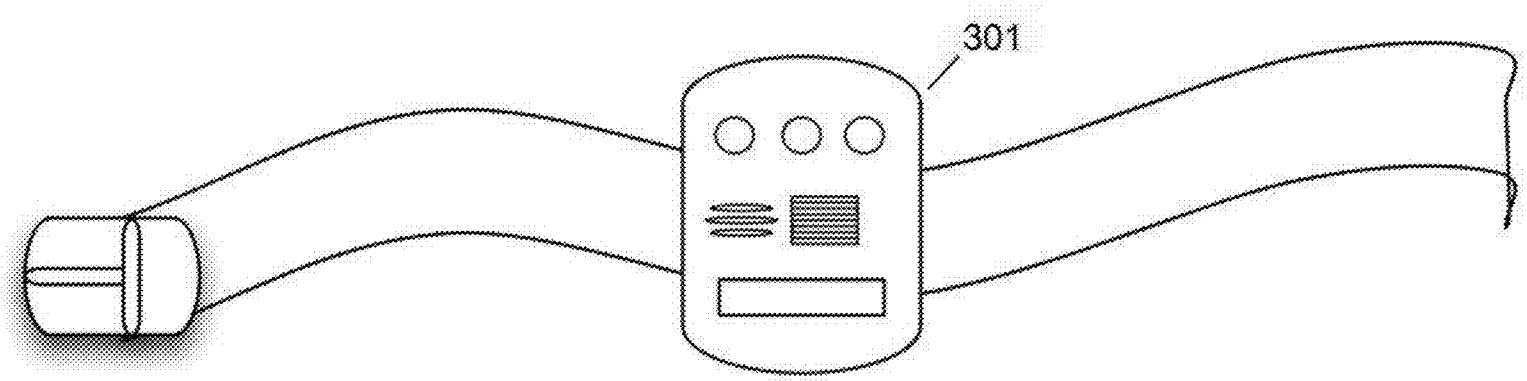
FIG. 3E is a front view of the embodiment of a receiving device depicted in FIG. 3A mounted on a strap suitable for attachment to a user's arm, leg, or waist.
Figure 3F:
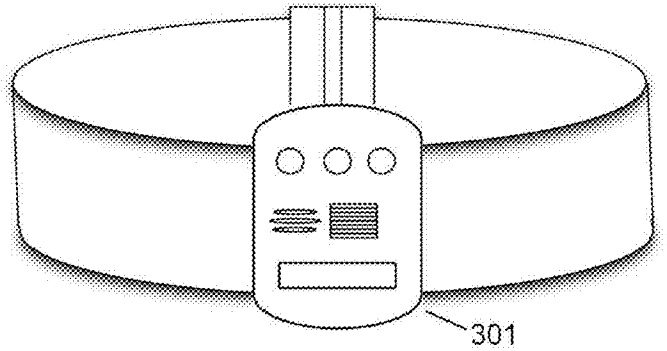
FIG. 3F is a front view of the embodiment of a receiving device depicted in FIG. 3A mounted on a collar suitable for attachment to the neck of an animal such as a dog.

FIG. 3C depicts the rear planar view of this embodiment of a receiving device 301. Clip 306 is provided to permit attachment of the receiving device 301 to the outer garment (s) of a users, such as a pocket, waistband, or any other convenient point of attachment. Alternate means of attachment are also envisioned by this disclosure, including but not limited to traditional hook-and-loop fasteners, magnetic attachment to the user's garments via a strong magnet (not shown) embedded in the rear surface of the enclosure which attaches to a separate removable magnetically attractive plate placed beneath at least one layer of the user's garment (s), thereby trapping the garment(s) between the magnet and the plate and securely affixing the receiving device to the user's person, attachment to the users via a strap, or via the use of any conventional methods by which said receiving device may be secured in a convenient and effective manner. Receiving device 301 also comprises a power on/off switch 312, which may also serve as a means to activate a self-test function for the receiving device to verify that the battery is charged and the display and all of the stimuli-causing components are functioning properly. Switch 312 may also be used to switch the receiving device between operational and configuration modes and may also be configured to activate any number of functions in response to specific patterns, such as one short press, some number of short presses within a certain time, one or more longer duration presses, combinations of short and longer presses, and the like.

The internal components of an embodiment of a receiving device 301 are shown in FIG. 3D. This figure depicts the placement of such components in direct positional correspondence to the front planar view of the receiving device in FIG. 3A with the front portion of the enclosure removed. Processor 308, memory/storage 314 (comprising any combination of RAM, ROM, EPROM, EEPROM, flash memory, or other temporary or persistent storage of data), display 305, and one or more batteries 313 together comprise a small computing platform that executes the functions of the receiving device performed with the remaining peripheral components. Stimuli-inducing components, including one or more illumination devices 302, haptic device 309 capable of generating vibration or other minor displacement stimuli capable of being sensed buy the user, and piezo element 310 are all activated simultaneously, or in some combinations less than all, when the receiving device determines that a signal has been received from a signaling device that is compatibly configured. Such determination is made when an incoming signal is received via antenna 311 and communicatively coupled to a wireless communication module 315 comprising one or more wireless communication ports, which then demodulates the signal and conveys the recovered information therefrom to processor 308. Processor 308 then compares the demodulated information with the communication configuration of receiving device 301, said configuration having been previously stored in memory 314. When processor 308 determines that a received signal is communicatively compatible with its own communication configuration, it activates at least one of the illumination device(s) 302, the haptic device 309, and the piezo element 310 in some combination to alert the user to the presence of an incoming compatible signal. In one embodiment, the duration of the activation is predetermined, preferably within the range of one to three seconds. Other durations may be preferred for certain applications and such duration may be established in the memory of the receiving device 301.

Display(s) 305 may present any information about the receiving device or its operation that may be useful to the user. For example, and without limitation, the display may present information regarding the current communication configuration of the receiving device, the state of charge of the one or more batteries 313, information regarding the data and time of the last compatible signal received, status and updating information while the receiving device is being configured, or the like.

Voltaic device 316 may be configured to perform one or more functions related to power management. In one embodiment, said voltaic device may be configured to process and regulate the current received from photosensor device 304 to be applied to batteries 313 or any other internal charge storage devices (not shown), including but not limited to one or more capacitors. In one embodiment, voltaic device 316 may be configured to function as an inductive device suitable for use with an inductive charging device as described in greater detail below.

The elements described above are depicted in this and the other drawings to represent their inclusion and not any specific manner in which they may be included. The shapes, positions, mounting configuration, and other details of their inclusion in signaling device 201 or receiving device 301 may be, but are not necessarily, representative in the manner in which they may be preferably installed. The placement of components is not intended to represent any preferred positional relationship but merely to depict their inclusion in the respective devices. Any number of other physical or operational configurations and embodiments are possible depending on the specific application envisioned for said configurations or embodiments. Not every embodiment of signaling device 201 or receiving device 301 may require or comprise all of the elements depicted in this embodiment. Only those elements required for any particular application of the invention need be included in a specific embodiment. Further, a person of ordinary skill in the art will immediately recognize any number of other embodiments envisioned by this disclosure, all of which are envisioned to be within the scope of this disclosure.

In one embodiment, signaling device(s) 201 and receiving device(s) 301 may be configured via direct wired connection or wireless connection to a suitable computing device, including but not limited to a laptop computer, desktop computer, computer-based electronic tablet, smartphone, or the like. In one embodiment depicted in FIG. 4, any number of signaling devices 201 and any number of receiving devices 301 may be utilized with charging and configuration station 401. In one embodiment, said charging and configuration station 401 is preferably configured to simultaneously recharge the batteries 203 of signaling devices 201 and receiving devices 301 via direct wired connection while also providing a wired platform to perform device configuration. In one embodiment, charging and configuration station 401 provides only charging capability, while in another embodiment, charging and configuration station 401 provides only device configuration capability.

In the embodiment depicted, configuration station 401 comprises a processor-based computing device 402 comprising one or more processor(s) 403, one or more memory device(s) 406, and one or more display(s) 410. Said station further comprises at least one keyboard, switch panel, or other input device 411 to provide user input, one or more connectors, jacks, or hardware connection points 412 to permit wired data exchange, and at least one wireless communication module 409 comprising one or more wireless communication ports to permit wireless data exchange, both for any useful configuration or operational purpose. Configuration station 401 may also comprise one or more illumination devices 404, one or more aural output devices 407 such as buzzers or other audio alarms, power generation circuits 405 including, but not limited to one or more photocells, and charging circuitry 408 such as, but not limited to, voltage regulation, current regulation, or the like.

Figure 4:
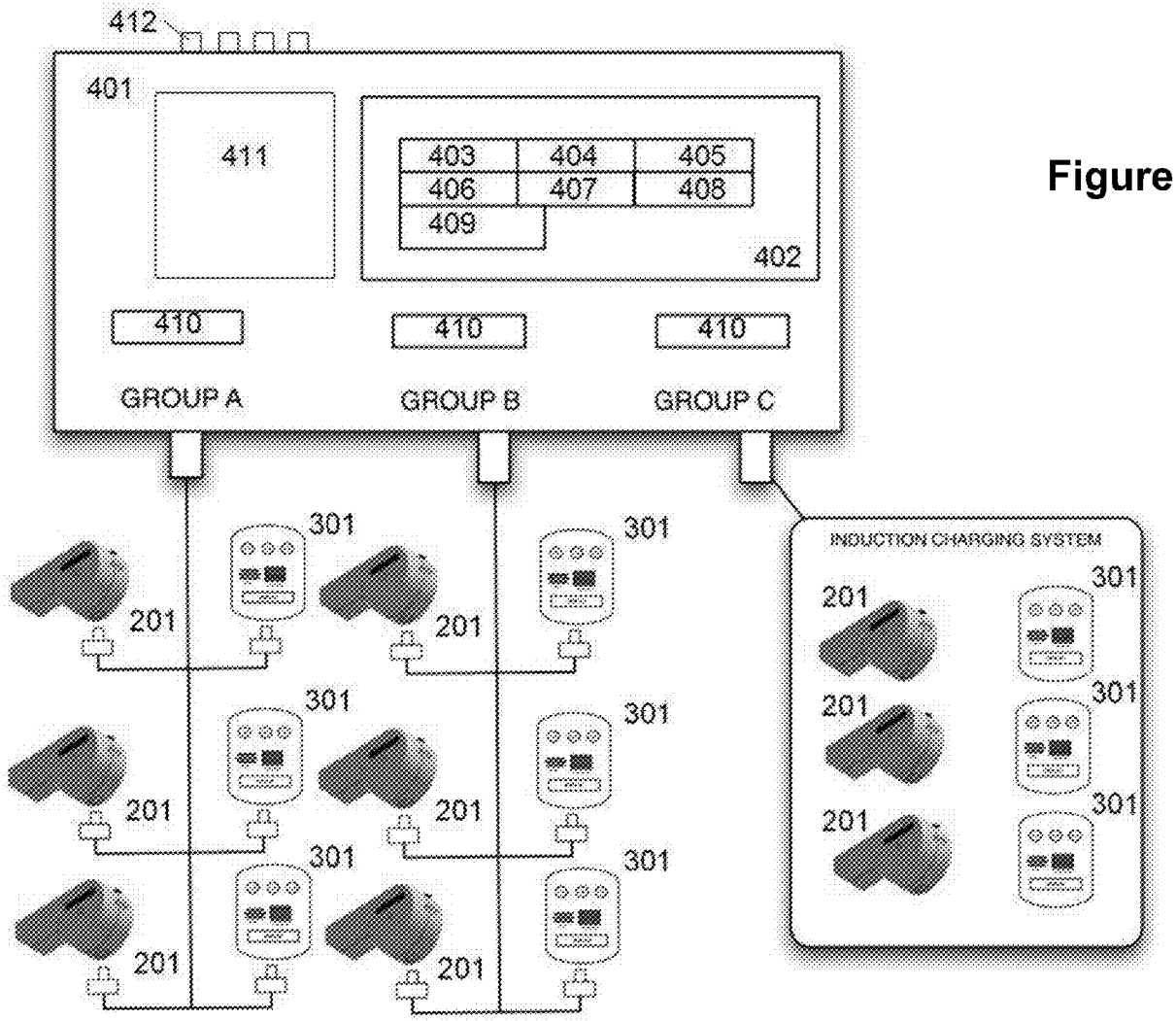
FIG. 4 is a depiction of one embodiment of a charging and configuration station suitable for wired and wireless use with the embodiments of the signaling device depicted in FIGS. 2A-2D and the receiving device depicted in FIGS. 3A-3F.

Using input device 411, one or more of display(s) 410, either the hardware connection points 412 or wireless communication module 409, and, in some embodiments, an external computing device, a user is able to configure the communication protocol of any of signaling device(s) 201 or receiving device(s) 301. Further, users may be able to store, update, or retrieve any software, firmware, or other data in storage or memories 209 and 314. As depicted in FIG. 4, devices may be associated into groups (wired Group A, wired Group B, and wireless Group C) to permit bulk configuration if desired. In this manner, more than one of either device may be identically and simultaneously configured to save time and ensure that consistent set-ups are achieved.

In the embodiment depicted, configuration station 401 is operative to configure and charge wired Group A and wired Group B devices via wired connector jack 204 of signaling device 201 and connector 307 of receiving device 301. In addition, said station is also configured to charge signaling devices 201 and receiving devices 301 of wireless Group C via the inductive charging process described above while performing any necessary or desired configuration functions via a wireless communication connection between wireless module 409 in station 401 and wireless communication modules 205 in signaling devices 201 and wireless communication modules 205 in receiving devices 301.

Embodiments described elsewhere herein pertaining to intermediate station devices are particularly advantageous when coverage is desired over a larger area than may be reliably achieved via direct communication between the signaling device and the signal receiving devices. These embodiments may also be particularly advantageous when it is desired to direct the communication toward a particular area or region or away from a particular area or region. The use of an intentionally directed transmission, such as but not limited to the use of a directional transmitting antenna or other focusing device, would increase the directivity of the communication signal and thereby further enhance the system's ability to function in close proximity to other instances of the system without adverse interaction.

In some embodiments, and depending on the nature of the signal, any transmitting apparatus disclosed herein may comprise an electromagnetic antenna in at least one of any configurations including one or more monopoles, dipoles, loops, wires, printed circuit boards, and the like, including arrays thereof, or one or more acoustic or electromagnetic directors such as a horn-shaped apertures, reflectors, baffles, and the like. Further, any of these and other devices may be utilized in any desired orientation based on operational requirements or preferences. These examples are provided only to illustrate the wide variety of possibilities and are not limiting upon the scope of this disclosure, as those skilled in the art will immediately appreciate that myriad possibilities exist for this element of the system taught herein.

In some embodiments, and for a variety of reasons, it may be desirable to limit the range at which effective signaling may be provided. Although a principal advantage of this invention is its high degree of configurability and compatibility with other instances of the system in relative close proximity, transmitting signals with a potential reception range far in excess of that required will lead to excessive drain of the batteries powering the devices, particularly those of signaling devices. In applications where only a very limited reception range would be useful, the devices may be configured to transmit with reduced power, fewer repeated signal bursts, or any combination of these or other power-conserving techniques.

As described above, communication configurations may comprise individual elements that permit receiving devices to distinguish one signal from another. Such individual elements include, but are not limited to, characterizations as to frequency, amplitude, modulated information, continuous wave transmission pattern, multiple carriers, and the like. Further, more than one means of signal characterization may be simultaneously applied. By way of illustration and not limitation, representative examples are provided herein of how such communication configurations may be deployed in several embodiments of this invention. These examples are not limiting upon the scope of this invention as any number of similar embodiments are also envisioned herein.

In these representative embodiments, the signaling devices and receiving devices communicate via radio frequency within any frequency band deemed suitable for the intended purpose and comprise any suitable digital modulation and demodulation scheme. The system may operate either as an unlicensed radiating system with appropriate limitations or as a licensed radiating system subject to all applicable laws and regulations governing such operations. The particular electromagnetic specifications of such system, including the frequency of operation, effective radiated power, modulation scheme(s), and the like are irrelevant to the instant description because the embodiment as described may be easily conformed to all applicable requirements by a person of ordinary skill in the art.

The system in the following example is designed to provide 10 (ten) separate communication configuration elements, identified in this example as elements A through J. Other systems may be designed to offer fewer or more elements. The signaling device may therefore be configured to include, within its communication configuration, any or all of configuration elements A through J. This configuration may be established in the signaling device by any desired means, including but not limited to one or more mechanical switches, electronic switches, data stored in an EEPROM, via the configuration station 401 disclosed above, or the like. The communication configuration of each receiving device may be similarly configured to comprise any or all of the communication configuration elements A through J, also established in each device by any practicable means that may be identical to or different from that utilized for the signaling device.

In these exemplary embodiments employing digital modulation, each of the elements A through J is associated with a unique data packet generated by the signaling device when a signal is to be transmitted. In other words, certain data unique to each element A through J is digitally modulated onto the carrier for each signal transmission whenever a signaling device is configured to transmit said element. Once received by a receiving device and demodulated, each of the individual data packets comprising one of the elements A through J are compared to the elements comprising the communication configuration of that receiving device. If at least one data packet is received by the receiving device where such packet is an element corresponding to an element present within its own communication configuration, the communication configurations are deemed by the receiving device to be compatible and the receiving device activates its response stimuli.

In a first exemplary embodiment, one signaling device (S1) and five receiving devices (R1-R5), all reasonably proximate, are configured as follows:

| Device | Elements present in device communication configuration | | | |
|---|---|---|---|---|
| S1 | A | B | E | G |
| R1 | A | C | | |
| R2 | B | E | F | |
| R3 | D | | | |
| R4 | D | G | | |
| R5 | D | F | | |

The data above reveals that signaling device S1 comprises four distinct elements in its communication configuration (elements A, B, E, and G). Receiving device R1 comprises only two elements (A and C), receiving device R2 comprises three elements (B, E, and F), and so on.

With these configurations, a signal transmitted from signaling device S1 will be incident upon all five receiving devices as they are all reasonably proximate to S1. However, upon demodulation and analysis of the received signal, only devices R1, R2, and R4 will respond by activating their stimuli. Each shares at least one common configuration element with S1, and therefore their communication configurations are compatible; S1 and R1 have element A in common, S1 and R2 have element B in common, and S1 and R4 have element G in common. Receiving devices R3 and R5 will not respond to the signal from S1 because their configurations are not compatible; neither have any configuration elements present in the communication configuration of signaling device S1, so neither will be activated.

In a second exemplary embodiment, devices S1 and R1-R5 are maintained as in the first exemplary embodiment but are now joined by a second signaling device S2, configured as follows:

| Device | Elements present in device communication configuration | | | |
|---|---|---|---|---|
| S1 | A | B | E | G |
| S2 | C | G | | |
| R1 | A | C | | |
| R2 | B | E | F | |
| R3 | D | | | |
| R4 | D | G | | |
| R5 | D | F | | |

Here, S1 and R1-R5 behave identically as in the previous embodiment. However, the addition of S2 now provides the ability to independently activate a response from a different set of receiving devices. A signal transmitted by S2 will activate only receiving devices R1 and R4, while R2, R3, and R5 will recognize that the communication configuration of S2 is not compatible with their own. Note that receiving device R1, comprising configuration elements in common with signaling device S1 (element A) and S2 (element C), will respond to a signal transmitted by either S1 or S2 as their communication configurations are compatible. However, receiving device R4 will respond only to signals transmitted by S2 due to the lack of compatibility between the communication configurations of R4 and S1 as they have no configuration elements in common.

The use of digitally modulated packets as communication elements in this example is illustrative only and not limiting. Any desired signal characteristic may be used as an element of the communication configurations of signaling and receiving devices. For example, in an analog system, each element may comprise an audio tone at a unique frequency simultaneously modulated onto the carrier of a signaling device via any preferred modulation scheme. Upon demodulation at the receiving device, the presence of any audio tone element at a frequency corresponding to one such element in the receiving device's communication configuration would be deemed to be compatible and would therefore activate its response stimuli. Further, when each element of a signaling device's communication configuration comprises a burst transmission at a specific carrier frequency unique to that element, detection by a receiving device of a burst at a specific frequency corresponding to an element within its own communication configuration would cause activation of its response stimuli. There is no limit on the manner of differentiation between elements of a communication configuration other than the simple requirement that receiving devices be capable of configuration to reliably differentiate each element from all of the others.

In some embodiments, the communications configurations are arranged in a hierarchal structure that permits compatibility between certain configurations for the purpose of organizing responses from the desired receiving devices. This arrangement is identical to that of a traditional lock and key system with a master key and several sub-master keys. Just as each lock will have its own key that operates on that lock alone and does not open any other lock in the family, each receiving device may have a communication configuration unique within the entire group of receiving devices as described above. A signaling device whose communication configuration is compatible with the communication configuration of only a single receiving device would activate a response in only that one receiving device. As a sub-master key will open a selected set of locks, but not all locks in the family, a selected group of receiving devices may be provided with a communication configuration element that activates a response from every device in that group whenever a signal is received from a signaling device also comprising the same element in its communication configuration. In some embodiments, the particular communication configuration of each signaling device may be compatible with one or more individual receiving devices, one or more groups of receiving devices, or any combination thereof. In some embodiments, the communication configuration of a particular signaling device may be compatible with every reasonably proximate receiving device (a "master configuration") just as a master key will open every lock in its hierarchy. This is particularly useful when all users in possession of receiving devices need to be notified simultaneously, such as in the case of an emergency involving health or safety. This embodiment is also useful when the system is deployed in an area removed from other instances of the system. The receiving devices would not need to be individually reconfigured where no possibility of unintended reception exists but the other advantages of the system, such as audible and tactile stimuli, would still be beneficial.

An important characteristic of the system of this invention is that the receiving device(s) are incapable of successfully receiving responding to any signal with which their respective communication configurations are not compatible. In systems of the present art, communications broadcast to a group of user-configurable devices for reception by one or more device are capable of being monitored by other receiving devices in the group regardless whether said device has received an activation signal or not. Here, receiving devices must be configured by the user to receive signals according to one or more configuration elements common to a preferred signaling device. Absent the presence of a common element in the respective communication configurations, the receiving device will ignore all signals from said signaling device and the user will never know they had ever been sent. Further, the user of the signaling device may select a communication configuration to specifically exclude certain receiving devices from receiving communications from said signaling device. Lacking information from the user of a signaling device regarding configuration of said device, a user of a receiving device will be unable to configure said receiving device to comprise an element in common with the signaling device to enable successful communication. This feature provides a measure of security not found in present systems where open channel communications are employed. Configuration of both the signaling (transmitting) device(s) and the receiving device(s) are within the purview of the user(s). Accordingly, the system disclosed herein provides a unique combination of broadcast transmission convenience and highly configurable selectable communication paths that provide all the advantages of the former with the numerous benefits of the latter. The combination of these features in a user-configurable system is both novel and highly useful in a myriad of applications discussed herein and elsewhere.

The description of this invention is intended to be enabling and not limiting. It will be evident to those skilled in the art that numerous combinations of the embodiments described above may be implemented together as well as separately, and all such combinations constitute embodiments effectively described herein.

What is claimed is:

1. A system for configurable communication, the system comprising:

A. at least one signaling device comprising a first stored communication configuration comprising one or more first configuration elements;

B. one or more receiving device(s) comprising:

(i) one or more external stimuli generator(s); and (ii) a second stored communication configuration comprising one or more second configuration elements;

wherein the at least one signaling device is configured to: a. receive an activation command; b. in response to said activation command, generate at least one signal comprising said first stored communication configuration; and c. transmit said at least one signal;

and wherein the one or more receiving device(s) are configured to:

d. directly receive the at least one signal transmitted by the at least one signaling device;

e. activate at least one of said one or more external stimuli generator(s) when said at least one signal comprises at least one of said one or more first configuration elements identical to at least one of said one or more second configuration elements; and f. do nothing when none of said one or more first configuration elements are identical to any of said one or more second configuration elements.

2. The system of claim 1 wherein the at least one signaling device and the at least one receiving device are further configured to communicate via electromagnetic wave communication, optical communication, or electromagnetic wave communication and optical communication.

3. The system of claim 2 wherein the at least one signaling device and the at least one receiving device may be configured by receiving and storing said first communication configuration and second communication configuration, respectively, communicated thereto via electromagnetic wave communication, optical communication, or electromagnetic wave communication and optical communication.

4. The system of claim 1 wherein:

A. said at least one signal comprises more than one signal;

B. said more than one signal is transmitted as a repeated burst signal comprising the entire first communication configuration; and C. said more than one burst signal is transmitted at one of any of uniform intervals, predetermined but non-uniform intervals, or randomized intervals.

5. The system of claim 1 wherein the one or more first configuration element(s) and the one or more second configuration element(s) comprise at least one of any of one or more frequencies, one or more wavelengths, one or more amplitudes, certain analog information, certain digital information, and a continuous wave transmission pattern.

6. The system of claim 5 wherein said analog information or digital information is modulated via at least one of any of amplitude, quadrature amplitude, pulse width, single sideband, frequency, phase, ampliphase, phase to amplitude, pulse code, pulse width, pulse amplitude, shift, keying, optical modulation, CW, or intermodulation product modulation.

7. The system of claim 1 comprising more than one receiving device and more than one first configuration elements, and wherein a first one of the more than one first configuration elements is operative to activate at least one of the one or more external stimuli generator(s) in a first portion of the more than one receiving devices and a second one of the more than one first configuration elements is operative to activate at least one of the one or more external stimuli generator(s) in a second portion of the more than one receiving devices.

8. The system of claim 1 wherein the one or more external stimuli generator(s) comprise at least one of any of a speaker, a buzzer, a bell, a siren, a haptic generator, a vibrating transducer, an electric potential, electrical or electromechanical visual display, a light, an LED, an LCD, and an OLED.

9. The system of claim 1 wherein the activation command comprises pushing a button, closing or opening a contact, throwing a switch, blowing into an electromechanical device, or performing a physical gesture.

10. The system of claim 1 wherein said at least one receiving device is further configured to retransmit said at least one signal comprising:

A. the communication configuration of said at least one signaling device; or

B. the communication configuration of said at least one receiving device.

11. A method for sending and receiving communications using a signaling device comprising a first communication configuration and one or more receiving device(s) comprising one or more external stimuli generator(s) and a second communication configuration, the method comprising:

A. storing at least one first configuration element in said first communication configuration;

B. storing at least one second configuration element in said second communication configuration;

C. generating, by the signaling device, a signal comprising said first communication configuration;

D. transmitting, by the signaling device, the signal comprising said first communication configuration;

E. directly receiving, by the one or more receiving device (s), the signal transmitted by the signaling device; and F. activating, at any of said one or more receiving device (s), at least one of the one or more external stimuli generator(s) if said received signal comprises any configuration element(s) identical to any of said at least one second configuration element(s).

12. The method of claim 11 wherein step D of transmitting and step E of receiving are performed using electromagnetic wave communication, optical communication, or electromagnetic wave communication and optical communication.

13. The method of claim 11 further comprising a step of configuring the signaling device by receiving and storing said first communication configuration, a step of configuring the receiving device by receiving and storing said second communication configuration, or a step of configuring the signaling device and the receiving device by receiving and storing said first and said second communication configurations in each device, respectively, communicated thereto via electromagnetic wave communication, optical communication, or electromagnetic wave communication and optical communication.

14. The method of claim 11 wherein the at least one first configuration element comprises analog or digital information communicated from the signaling device to the receiving device by electromagnetic wave communication, optical communication, or electromagnetic wave communication and optical communication.

15. The method of claim 11 further comprising a step wherein said receiving device retransmits the signal received from said signaling device comprising:

A. the communication configuration of said signaling device; or

B. the communication configuration of said receiving device.

16. A system for sending and receiving communications, the system comprising:

A. one or more signaling device(s);

B. one or more receiving device(s), each comprising one or more external stimuli generator(s);

C. one or more first communication configuration(s) selectable at each of the one or more signaling device (s) and one or more second communication configuration(s) selectable at each of the one or more receiving device(s), each said communication configuration comprising at least one configuration element;

wherein the system is configured to:

a. generate one or more signal(s) at each of the one or more signaling device(s) comprising all of said at least one configuration element(s) of a selected first communication configuration;

b. transmit said one or more signal(s) by said one or more signaling device(s) and directly receive said signal(s) by said one or more receiving device(s); and c. activate at least one of the one or more external stimuli generator(s) associated with any of the one or more signal receiving device(s) whenever at least one configuration element of the selected second communication configuration of the respective signal receiving device(s) comprise at least one element in common with the communication configuration of said signal(s).

17. The system of claim 16 wherein said one or more signaling device(s) and said one or more receiving device(s) are further configured to transmit and receive, respectively, via electromagnetic wave communication, optical communication, or electromagnetic wave communication and optical communication.

18. The system of claim 16 wherein the one or more signaling device(s) and the one or more receiving device(s) may be configured by receiving and storing said one or more first communication configuration(s) and one or more second communication configuration(s), respectively, communicated thereto via electromagnetic wave communication, optical communication, or electromagnetic wave communication and optical communication.

19. The system of claim 16 comprising more than one receiving device wherein:

A. said first communication configuration(s) comprise more than one first configuration elements;

B. at least a first of said more than one first configuration elements is identical to at least one configuration element of at least a first portion of said one or more second communication configuration(s); and C. at least a second of said more than one first configuration elements is identical to at least one configuration element of at least a second portion of said one or more second communication configuration(s).

20. The system of claim 16 wherein said one or more receiving device(s) are further configured to retransmit said one or more signal(s) comprising:

A. the communication configuration of said one or more signaling device(s); or

B. the communication configuration of said one or more receiving device(s).

* * * * *